US005752150A

United States Patent [19]

Kato et al.

[11] Patent Number: 5,752,150

[45] Date of Patent: May 12, 1998

[54] HEATING APPARATUS

[75] Inventors: Takeshi Kato; Eiji Okabayashi; Satoru Yoneda; Yuusuke Morigami, all of Toyohashi; Tetsuro Ito, Anjo, all of Japan

[73] Assignee: Minolta Co., Ltd., Osaka, Japan

[21] Appl. No.: 707,685

[22] Filed: Sep. 4, 1996

[30] Foreign Application Priority Data

| | | | |
|---|---|---|---|
| Sep. 4, 1995 | [JP] | Japan | 7-226768 |
| Sep. 11, 1995 | [JP] | Japan | 7-232957 |
| Oct. 30, 1995 | [JP] | Japan | 7-281996 |
| Jan. 12, 1996 | [JP] | Japan | 8-004152 |
| Jan. 16, 1996 | [JP] | Japan | 8-004849 |

[51] Int. Cl.[6] ..... G03G 15/20

[52] U.S. Cl. ..... 399/330; 219/619; 219/671

[58] Field of Search ..... 399/328, 330; 219/216, 469, 619, 671

[56] References Cited

U.S. PATENT DOCUMENTS

| | | | |
|---|---|---|---|
| 4,570,044 | 2/1986 | Kobayashi et al. | 219/619 |
| 5,074,019 | 12/1991 | Link | 492/7 |
| 5,526,103 | 6/1996 | Kato et al. | 399/328 |
| 5,552,582 | 9/1996 | Abe et al. | 219/619 |
| 5,568,240 | 10/1996 | Ohtsuka | 399/335 |

FOREIGN PATENT DOCUMENTS

| | | |
|---|---|---|
| A54-039645 | 3/1979 | Japan . |
| A58-178385 | 10/1983 | Japan . |
| A59-033477 | 2/1984 | Japan . |

*Primary Examiner*—Matthew S. Smith

[57] ABSTRACT

The induction-heating apparatus of this invention contains a conductive member, a power source, and a first and a second induction coil connected to the power source and adapted for causing the conductive member to generate an induced current, the first and the second induction coil being parallelly connected. The induction coil is formed by winding a copper wire round a core in such a manner that the numbers of turns of the copper wire gradually decrease from the lowermost layer approximating most closely to the core to the upper layers. This heating apparatus has the thickness of the induction coil in the range of 0.2–0.8 mm. The gap between the induction coil and the conductive member is in the range of 0.5–4.0 mm. This heating apparatus has the induction coil thrust out of the conductive member. The induction coil is formed of a Litz wire.

23 Claims, 30 Drawing Sheets

HEATING APPARATUS

BACKGROUND OF THE INVENTION

1. Field of the Invention

This invention relates to a heating apparatus and particularly to a heating apparatus of the principle of induction heating.

2. Description of the Prior Art

Heretofore it has been proposed to apply heating apparatuses of the principle of induction heating for such fixing apparatuses as are incorporated in electrophotographic copying devices, printers, and facsimile systems.

As respects the application of a heating apparatus of the principle of induction heating for a fixing apparatus, JP-A-54-39,645 and JP-A-59-33,787, for example; disclose a fixing apparatus which, by means of an open magnetic circuit iron core formed by helically winding an induction coil and disposed inside a fixing roller made of a metallic conductor, is operated by flowing a high-frequency current through the induction coil approximating closely to the inner surface of the fixing roller, utilizing a high-frequency magnetic field consequently formed for inducing the fixing roller to generate an induced eddy current, and harnessing the skin resistance produced consequently by the fixing roller itself for enabling the fixing roller itself to emit Joule heat.

JP-A-58-178,385 discloses a fixing apparatus which is provided with two induction coils and is adapted to switch the flow of current to the two induction coils depending on the size of paper to be used, i.e. cause the current to flow to only one of the induction coils when the paper has a small size or to both the two induction coils when the paper has a large size thereby enables induction heating exclusively to occur in the surface area that is in need of heating and promote conversion of energy.

The induction heating of this nature is advantageous over the other forms of heating in the following respects.

Firstly, it elevates the temperature of the fixing roller quickly and insignificantly incurs generation of heat in or conduction of heat to the components other than the fixing roller as compared with the indirect heating such as the near-infrared heating with a tungsten halogen lamp. It does not suffer any loss which is equivalent to the leakage of light incurred by the tungsten halogen lamp. Secondly, it generates heat with high efficiency because it has the skin effect peculiar to electromagnetic induction and it enjoys lasting reliability of the fixing apparatus because it uses no sliding contact as compared with the surface heating which makes use of a solid resistance heating element on the surface of a fixing roller. Thirdly, it excels in terms of temperature control because it incurs loss of heat conduction insignificantly due to contact resistance and enjoys easy detection of the temperature of the surface of heat generation as compared with the heating which makes use of a film belt and a solid resistance heating element.

In spite of all these advantages, the fixing apparatus of the principle of induction heating has problems yet to be solved.

The problem of noise is one of them. When the oscillation caused jointly by the induction coil intended for the generation of induced current and the resonance capacitor falls within an audio frequency band (about 15 Hz–20 kHz), this oscillation forms the source of noise in the fixing apparatus.

The frequency, f, of the oscillation caused by the induction coil and the resonance capacitor is found roughly by the calculation of the following formula (1) (which will be described more specifically hereinbelow).

$$f = 1/(Ip \times L/LV + 1.5\pi\sqrt{LC}) \quad (1)$$

In the formula, Ip represents the peak value of an induction coil current, L the inductance of the induction coil, VI the voltage applied to the induction coil, and C the capacity of the resonance capacitor.

It is noted from the formula (1) that the frequency of the oscillation varies with the inductance of the induction coil.

The frequency of the oscillation, therefore, can be deviated from the audio frequency band by lowering the inductance of the induction coil. Where the induced current is generated by one induction coil as disclosed in JP-A-59-33,787 mentioned above, a reduction effected in the length of the induction coil for the purpose of decreasing the inductance of the induction coil prevents acquisition of an ampere turn necessary for induction heating and consequently widens the gap from the fixing roller (member subjected to heating) and degrades the efficiency of heat generation. This hardship may be coped with by increasing the thickness of the core and decreasing the gap or by increasing the thickness of the induction coil. This measure is economically unfavorable because the core gains in volume and the work of winding the induction coil of an increased thickness impairs the operational efficiency of production and the cost of production is inevitably increased.

Where a plurality of induction coils are used as disclosed in JP-A-58-178,385 mentioned above, though the inductance of each of the induction coils is low, the combined inductance of the plurality of induction coils connected in series is as high as when just one induction coil is used and consequently entails the same problem as mentioned above. Where the plurality of induction coils are controlled separately from one another, as many control circuits as the induction coils are required and the cost is proportionately increased.

Another problem is that the heat generated by the induction coil itself excessively elevates the temperature inside the fixing roller. This hardship arises because the heat generated by the resistance of the induction coil itself in consequence of the flow of current through the induction coil cannot be fully radiated in the narrow space inside the fixing roller. For the purpose of avoiding this drawback, it becomes necessary to lower the resistance by increasing the thickness of the induction coil or to form the fixing roller and neighboring members with materials of high heat resistance. In this respect, JP-A-54-39,645 mentioned above contemplates avoiding the excessive elevation of temperature by winding the induction coil helically round the fixing roller thereby giving rise to an empty core part therein and flowing air through the empty core part and repressing the elevation of temperature in the fixing roller.

It is indeed important to overcome the drawback of the excessive elevation of the temperature of the fixing roller. When the induction coil of a large thickness is used so as to lessen the copper loss of the induction coil itself for the purpose of lowering the magnitude of the resistance of the induction coil as described above, however, the empty space which is allowed for winding the induction coil is necessarily limited because the induction coil is disposed inside the fixing roller. The use of the induction coil of a large thickness, therefore, entails the problem that the number of turns of the coil is proportionately decreased and the necessary ampere turn is no longer obtained. When materials of high heat resistance are used for the members neighboring the fixing roller, these members become so expensive as to render the apparatus uneconomical.

As means to cool the induction coil for the purpose of preventing the temperature thereof from rising, JUM-A-55-29,492, for example, proposes a technique of covering the core disposed inside the induction coil to be wound with a ventilation pipe and flowing air by means of a fan motor through the interior of the ventilation pipe and JUM-A-55-18,292 discloses a technique of disposing round the induction coil a radiation pipe adapted to supply air to the periphery of the induction coil.

In JP-A-54-39,645 mentioned above, however, the supply of air to the empty core of the helically wound induction coil needs a means for ventilation and the power which is required for the ventilating means counters the demand for energy conservation mentioned above. The extra provision of the ventilating means entails the problem of inevitably increasing the cost. Likewise, JUM-A-55-29,492 and JUM-A-55-18,292 are at a disadvantage in complicating facilities and rendering them expensive because they require a ventilating pipe for covering the core and a fan motor for flowing air thereto or a radiation pipe for encircling the induction coil and a means for flowing air thereto. JUM-A-55-29,492 in particular contemplates the structure in which the induction coil is wound on the ventilating pipe covering the core. The means to generate a magnetic flux, therefore, has a large volume. When such a hollow heating member as the fixing roller of a small diameter is used, therefore, this structure has the problem that the magnetic flux generating means mentioned above cannot be installed within the fixing roller.

One of the fixing apparatuses of the principle of induction heating has a structure in which an induction coil is produced by forming a winding round a core destined to constitute a magnetic circuit. The following relation exists between the distance from the core to the fixing roller and the efficiency with which the fixing roller is heated (efficiency of energy transmission). When the distance between the core and the fixing roller is shortened, since the magnetic coupling gains in intensity, the heating efficiency is improved and the amount of heat generated in the fixing roller is exalted. Conversely, when the distance is lengthened, since the magnetic coupling is consequently weakened, the efficiency of heating is degraded and the amount of heat generated is decreased.

For the purpose of preventing the fixing apparatus from forming a short-circuit and consequently sustaining damage, it is necessary to secure thorough electric insulation between the fixing roller and the core. For the same reason, electric insulation is required to exist between the fixing roller and the induction coil.

For the purpose of securing the thorough electric insulation mentioned above, it suffices to lengthen the distance between the fixing roller and the core. The structure which embodies the lengthened distance, however, fails to obtain a thorough heating efficiency as pointed out above. In this case, for the purpose of enabling the fixing roller to acquire a prescribed amount of heat generation, it is necessary to flow current amply to the induction coil. The flow of an ample amount of current, however, entails copper loss of the induction coil to the extent of increasing the amount of heat generated and elevating the temperature of the induction coil itself even to a level exceeding 200° C. As a result, the holders for supporting the core and the induction coil as well as the induction coil itself are required to use expensive materials capable of enduring the temperature mentioned above. The use of these materials not only adds to the cost of the apparatus but also counters the demand for energy conversion.

One of the fixing apparatuses of the principle of induction heating uses a flexible metallic sleeve of a small wall thickness as a hollow heating member in the place of the fixing roller. It nevertheless encounters the same situation as described above.

SUMMARY OF THE INVENTION

This invention, with a view to solving the problems of the prior art mentioned above, has an object of providing a heating apparatus for use in a fixing apparatus, which secures a necessary ampere turn and lowers the whole inductance of an induction coil and prevents an oscillation occurring in the audio frequency band without sacrificing the efficiency of heating.

Another object of this invention is to provide a heating apparatus for use in an induction-heating fixing apparatus which is capable of economically and efficiently preventing the temperature of the fixing roller used in the fixing apparatus from being elevated excessively.

Still another object of this invention is to provide a heating apparatus for use in a fixing apparatus which secures thorough electric insulation between a hollow metallic member and a core and allows highly efficient heating.

Yet another object of this invention is to provide a heating apparatus for use in a fixing apparatus which is capable of cooling an induction coil with a simple and inexpensive mechanism and adaptable even to a fixing roller of a small diameter.

In one preferred embodiment, the heating apparatus of this invention is intended to be used as a fixing apparatus which serves the purpose of enabling a toner image formed on a recording medium to be fixed thereto and is characterized by being provided with a conductive member and at least two parallelly connected induction coils for enabling the conductive member to produce an induced current and emit heat.

By having at least two induction coils parallelly connected as described above, the heating apparatus is enabled to heighten the frequency of oscillation enough to depart from the audio frequency band, select an optimum frequency, and preclude the otherwise inevitable occurrence of noise. As a result, it attains prevention of noise easily without adopting such measures as enlarging the core and increasing the thickness of the induction coil which incur a rise of cost.

In a further preferred embodiment, the heating apparatus of this invention is intended to be used as a fixing apparatus which serves the purpose of enabling a toner image formed on a recording medium to be fixed thereto and is characterized by being provided with a conductive member, a core formed inside the conductive member and disposed in a direction perpendicular to the direction of a rotary shaft of the conductive member, and an induction coil wound on the core along the direction of the rotary shaft of the conductive member, the induction coil being so wound that the numbers of turns gradually decrease from the lowest layer approximating most closely to the core to the upper layers.

Since the induction coil is so wound that the numbers of turns gradually decrease from the lowermost layer approximating the core to the upper layers as described above, the heating apparatus enjoys a good utilization factor of the space inside the conductive member, derives a necessary ampere turn from the induction coil of a large thickness, and decreases the amount of heat generated by the induction coil during the flow of current, and consequently prevents the temperature of the conductive member from being excessively elevated. It further enjoys an exalted ratio of thermal conversion and a decrease of power consumption owing to the decreased distance between the induction coil and the conductive member.

In another preferred embodiment, the heating apparatus of this invention is intended to be used as a fixing apparatus which serves the purpose of enabling a toner image formed on a recording medium to be fixed thereto and is characterized by being provided with a cylindrical conductive member, a core formed inside the conductive member and disposed in a direction perpendicular to the direction of a rotary shaft of the conductive member, and an induction coil wound on the core along the direction of the rotary shaft of the conductive member, the induction coil having an outside diameter in the range of 0.2–0.8 mm.

By having the outside diameter of the induction coil fixed in the range of 0.2–0.8 mm as described above, the heating apparatus is enabled to minimize the magnitude of effective resistance of the induction coil exposed to exertion of a high frequency, improve the energy efficiency of the current flowing through the induction coil, minimize the heat generation of the induction coil, and prevent the temperature of the inductive member from being elevated excessively.

In still another preferred embodiment, the heating apparatus of this invention is intended to be used as a fixing apparatus which serves the purpose of enabling a toner image formed on a recording medium to be fixed thereto and is characterized by being provided with a conductive member, a core made of a magnetic material, an induction coil produced by forming a winding round the core through the medium of an insulating part and adapted for causing the conductive member to produce an induced current and consequently emit heat, and a non-rotatable retaining member supporting the core and the induction coil and stowed inside the conductive member, the core being disposed to interpose a distance of not less than 0.5 mm and not more than 4 mm between the core and the conductive member.

Owing to the structure produced as described above, the heating apparatus is enabled to prevent the temperature of the induction coil from being elevated, obviate the necessity of using an expensive material, and repress the rise of cost. It further is enabled to curb the degradation of the efficiency of heating and contribute to energy conservation. It also secures thorough electric insulation between the conductive member and the core. In this structure, even when the core is approximated more closely to the inner surface of the hollow metallic roller formed of the conductive member, the electric insulation between the hollow metallic roller and the core and the induction roller is further ensured. When the coating of the induction coil happens to be broken as by the excessive temperature elevation, for example, the structure secures the electric insulation and prevents the fixing apparatus as a whole from being broken.

In a further preferred embodiment, the heating apparatus of this invention is intended to be used as a fixing apparatus which serves the purpose of enabling a toner image formed on a recording medium to be fixed thereto and is characterized by being provided with an induction coil adapted to generate a magnetic flux inside the conductive member, the induction coil being enabled to admit the flow of a high-frequency current and generate electromagnetic induction in response thereto and consequently heat the conductive member by virtue of electromagnetic induction and the induction coil being projected into the ambience from the terminal part in at least one of the axial directions of the fixing apparatus.

Since the induction coil is projected into the ambience from the terminal part in at least one of the axial directions of the fixing apparatus as described above, the outwardly projected and exposed part of the induction coil can be spontaneously cooled by the ambient air. The cooling effect is exalted by the fact that the induction coil itself is formed of copper, a substance excelling in the ability to radiate heat. As the radiation of heat from the entirety of the induction coil is thus promoted, the elevation of the temperature of the induction coil can be curbed.

DETAILED DESCRIPTION OF THE INVENTION

These and other objects, advantages and features of the invention will become apparent from the following description thereof taken in conjunction with the accompanying drawings which illustrate specific embodiments of the invention.

EXAMPLE 1

Example 1 embodying this invention concerns a heating apparatus for use in a fixing apparatus. This heating apparatus has at least two induction coils for effecting induction heating of a fixing roller formed of conductive members parallelly connected and has the parallelly connected induction coils set in place inside the fixing roller.

Figure 1:
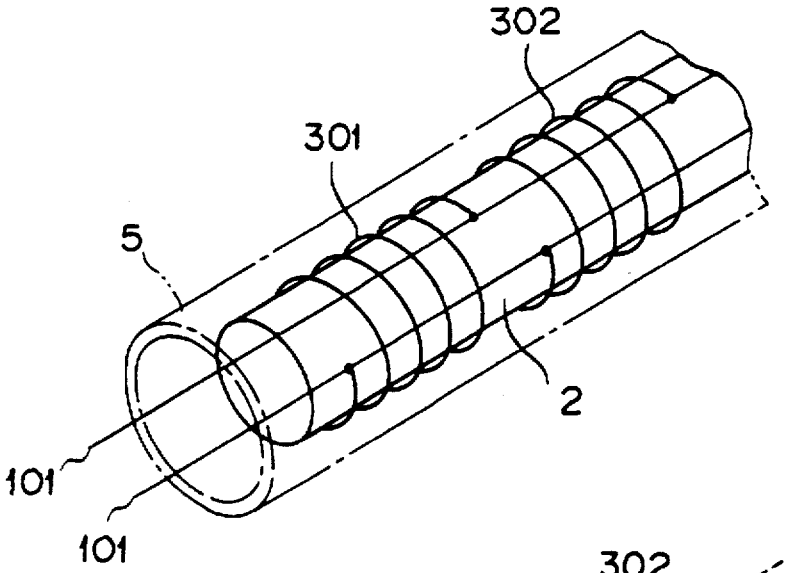
FIG. 1 is a perspective view illustrating one form of the heating apparatus of Example 1 embodying this invention.
Figure 2:
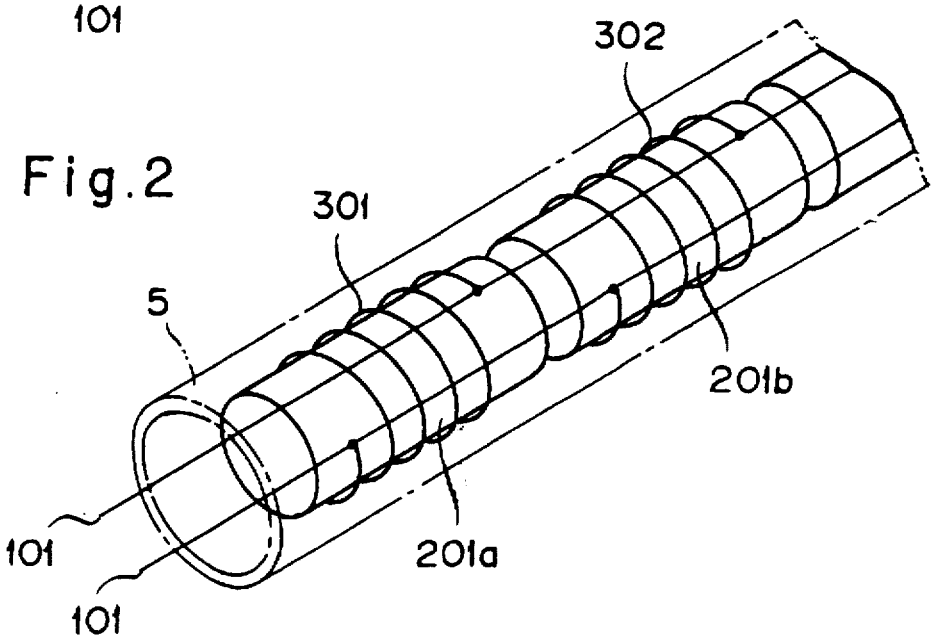
FIG. 2 is a perspective view illustrating another form of the heating apparatus of Example 1 embodying this invention.
Figure 3:
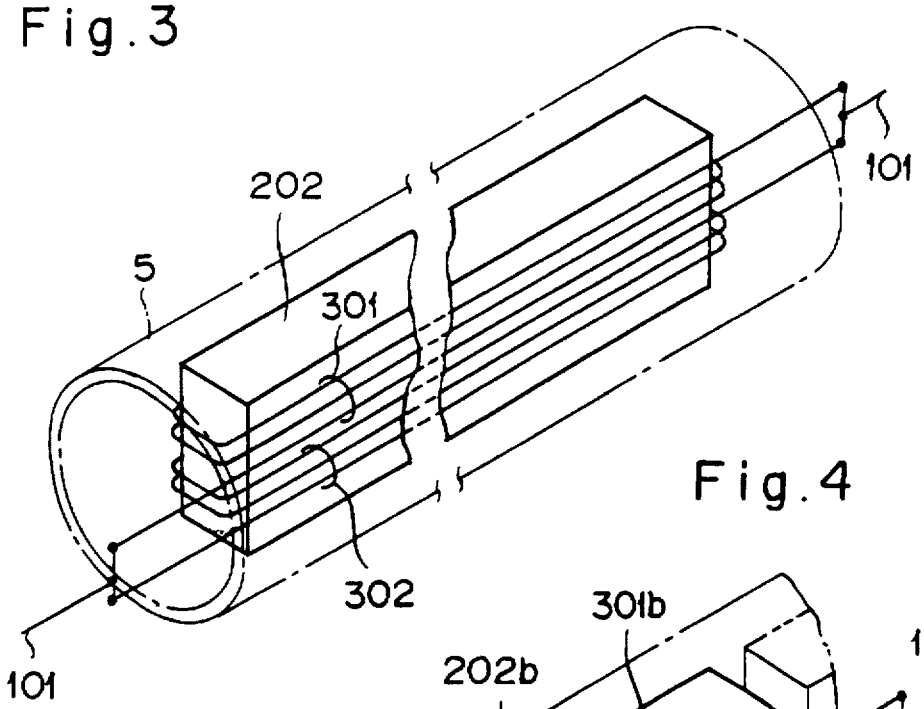
FIG. 3 is a perspective view illustrating still another form of the heating apparatus of Example 1 embodying this invention.
Figure 4:
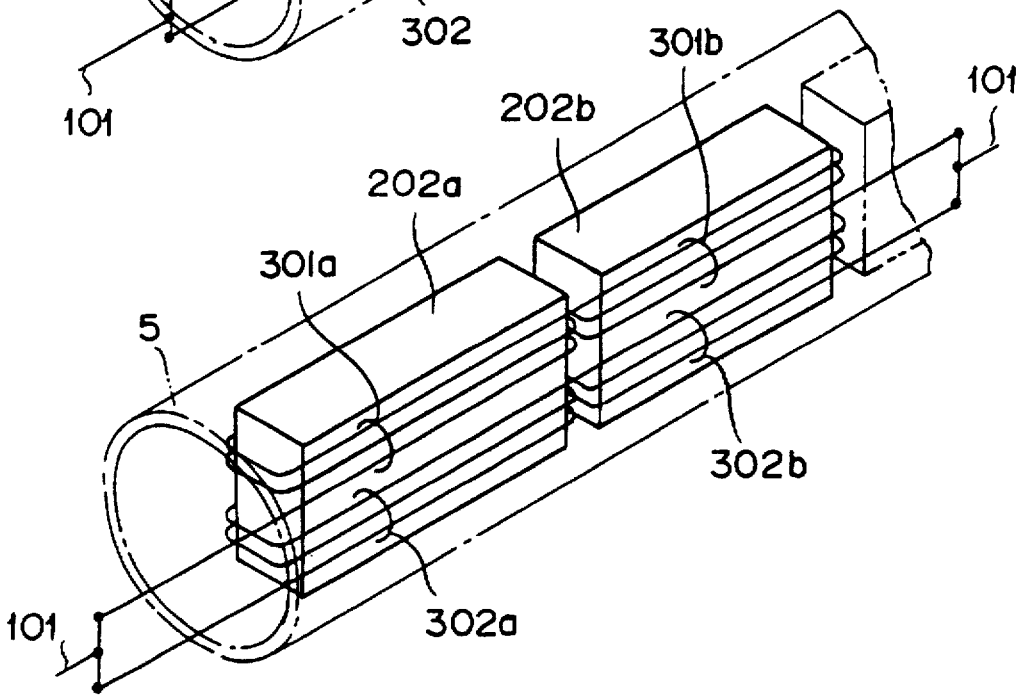
FIG. 4 is a perspective view illustrating yet another form of the heating apparatus of Example 1 embodying this invention.

Specifically, this heating apparatus is produced, for example, by helically winding a plurality of induction coils 301, 302, . . . on one cylindrical core 2 inside a conductive fixing roller 5 and parallelly connecting the induction coils 301, 302, . . . as shown in FIG. 1, by helically winding induction coils 301, 302, . . . severally on a plurality of cores 201*a*, 201*b*, . . . inside the conductive fixing roller 5 and parallelly connecting the induction coils 301, 302, . . . as shown in FIG. 2, by winding a plurality of induction coils 301, 302, . . . in the longitudinal direction on one prismatic core 202 and parallelly connecting the induction coils 301, 302, . . . as shown in FIG. 3, or by winding induction coils 301*a*, 301*b*, and 302*a*, 302*b*, . . . in the longitudinal direction severally on a plurality of prismatic cores 202*a*, 202*b*, . . . serially connecting the induction coils 301*a*, 301*b*, . . . and 302*a*, 302*b*, . . . severally, and parallelly connecting the serially connected induction coils 301*a*, 301*b*, . . . and 302*a*, 302*b*, . . . as shown in FIG. 4. In each of the diagrams, an electric wiring 101 is connected to a high-frequency power source and a resonance capacitor.

Figure 5:
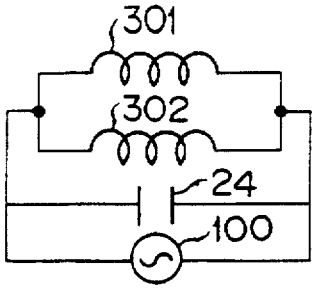
FIG. 5 is a circuit diagram illustrating a further form of the heating apparatus of Example 1 embodying this invention.
Figure 6:
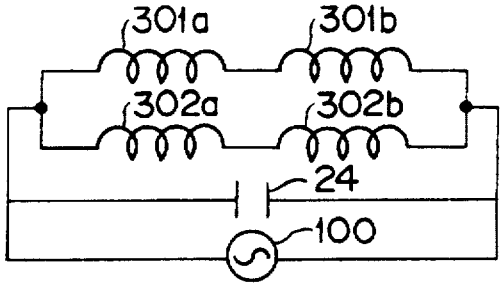
FIG. 6 is a circuit diagram illustrating another form of the heating apparatus of Example 1 embodying this invention.
Figure 7:
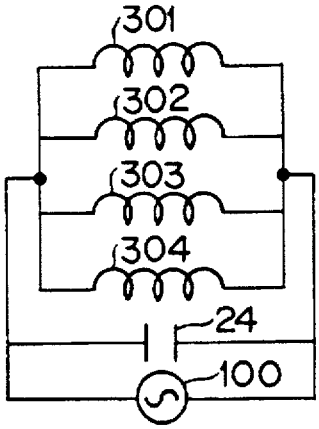
FIG. 7 is a circuit diagram illustrating still another form of the heating apparatus of Example 1 embodying this invention.
Figure 8:
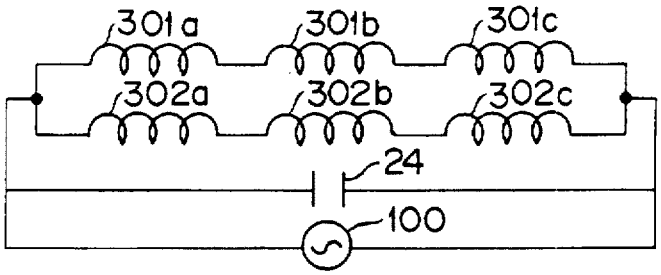
FIG. 8 is a circuit diagram illustrating yet another form of the heating apparatus of Example 1 embodying this invention.
Figure 9:
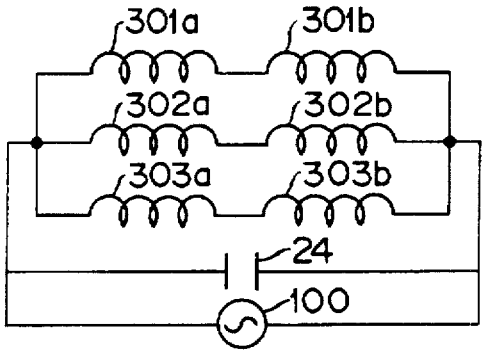
FIG. 9 is a circuit diagram illustrating a further form of the heating apparatus of Example 1 embodying this invention.
Figure 10:
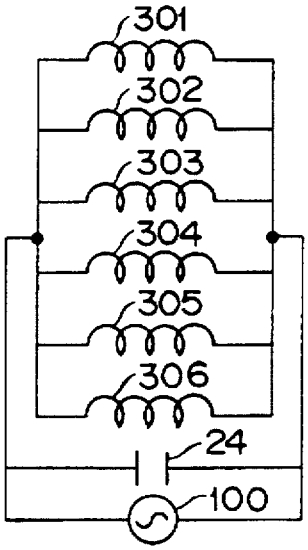
FIG. 10 is a circuit diagram illustrating one form of the induction heating apparatus of Example 1 embodying this invention.

The embodiments of the fixing apparatus which vary the number of induction coils to be used will be illustrated below with the aid of a circuit diagram. They are formed by connecting two induction coils 301 and 302 parallelly as shown in FIG. 5, by connecting induction coils 301*a* and 301*b* and induction coils 302*a* and 302*b* severally serially and connecting the two serially connected pairs parallelly in two rows as shown in FIG. 6, by connecting four induction coils 301, 302, 303, and 304 parallelly as shown in FIG. 7, by connecting the induction coils 301*a*, 301*b*, and 301*c* and induction coils 302*a*, 302*b*, and 302*c* severally serially and connecting the serially connected triples parallelly in two rows as shown in FIG. 8, by connecting induction coils 301*a* and 301*b*, induction coils 302*a* and 302*b*, and induction coils 303*a* and 303*b* severally serially and connecting the three serially connected pairs parallelly in three rows as shown in FIG. 9, or by connecting six induction coils 301, 302, 303, 304, 305, and 306 parallelly as shown in FIG. 10, for example. In each of the diagrams, the reference numeral 24 represents a resonance capacitor and the reference numeral 100 a high-frequency power source.

In Example 1, such a cylindrical fixing roller as mentioned above is used and adapted to be directly subjected to induction heating. When this fixing roller is to be used as a fixing apparatus, the fixing roller may be made of a heat-resistant resin and a metallic plate for induction heating may be disposed inside the resinous fixing roller. Otherwise, a metallic plate may be disposed through the medium of a film following the motion of a recording medium and adapted for induction heating instead of using the fixing roller.

Now, the operation obtained by parallelly connecting a plurality of induction coils as shown above will be described in detail below.

First, the operation for the induction heating of the fixing roller will be described.

The induction heating arises from the oscillation which is generated between the induction coils and the resonance capacitor when the high-frequency source adapted to apply a high frequency to the induction coils is turned on. With reference to the voltage-current chart shown in FIG. 11, when the power source voltage $V_G$ is turned on, the current flows through the induction coils and the magnitude of current $I_D$ is consequently increased. The power source $V_G$ is turned off when the magnitude of current $I_D$ reaches its peak value Ip. Consequently, the energy accumulated in the induction coils charges the resonance capacity and the voltage $V_D$ of the capacitor is increased, with the result that the energy of the induction coils is wholly spent in charging the capacitor. Now, the capacitor plays the part of discharging.

The period of the oscillation, therefore, is expressed as the sum of the time, Ta, required for the current flowing to the induction coils in consequence of the accumulation of energy in the induction coils to reach the peak value, Ip, and the time, Tb, required for the capacitor to be recharged and discharged.

Thus, the determination of the frequency of the oscillation is initiated by finding the duration, Ta, between the time the accumulation of energy in the induction coils is started and the time the current reaches its peak value, Ip.

The relation between the voltage, $V_I$, applied to the induction coils and the inductance of the induction coils is expressed as $V_I=L\cdot di/dt$.

The relation between the current and the time, therefore, is given as $di/dt=V_I/L$.

It follows that the time, Ta, required for the current to reach the value, Ip, is expressed as $Ta=Ip\cdot L/V_i$.

Then, the time, Tb, which is required for the capacitor to be recharged and discharged is found.

It is divided into the time for recharging, Tb', and the time for discharging, Tb". The time for discharging, Tb", is decided by the period of resonance generated by the induction coils and the capacitor. The period of resonance, $T_o$, is found as $T_o=2\pi\sqrt{LC}$ in accordance with the formula, $f_o=1/(2\pi\sqrt{LC}$, for the calculation of the resonance frequency, $f_o$.

Hence, Tb" is found as $Tb''=\pi\sqrt{LC}$.

Since Tb is about 1.5 times Tb", Tb is found by approximation as $Tb=Tb''+Tb'=1.5Tb''$.

The oscillation frequency f, therefore, is found by the following formula.

$$f=1/(Ta+Tb)=1/(I_p\cdot L/V_I+1.5\pi\sqrt{LC}) \quad \text{(A)}$$

Figure 12:
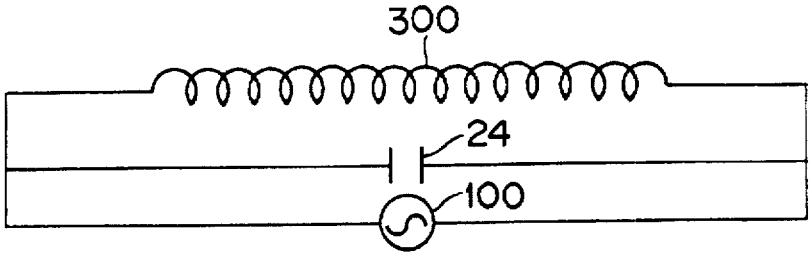
FIG. 12 is a circuit diagram illustrating an induction coil connection for comparison.

Here, the oscillation frequency generated when the induction coils are parallelly connected as shown in FIG. 6 and FIG. 7 mentioned above will be calculated in accordance with the formula (A) by way of example. For the purpose of comparison, the oscillation frequency generated when four equally divided induction coils 300*a*, 300*b*, 300*c*, and 300*d* are serially connected as shown in FIG. 13 where a necessary ampere turn is derived by one induction coil 300 as shown in FIG. 12 will be calculated.

Here, for the calculation of the oscillation frequency, it is assumed that the voltage $V_I$ applied to the induction coils is 100 V, the value of peak current $I_p$ is 7 *A*, the capacity C of the resonance capacitor is 0.033 μF, and the inductance L of one induction coil is 400 μH.

Thus, the inductance of all the induction coils is found as 400×2×½=400 μH in the circuit shown in FIG. 6 and 400×¼×100 μH in the circuit shown in FIG. 7, both embodying this invention. In contrast, the inductance is found as 400×4=1600 μH in the circuit having four induction coils serially connected as shown in FIG. 13.

Figure 13:
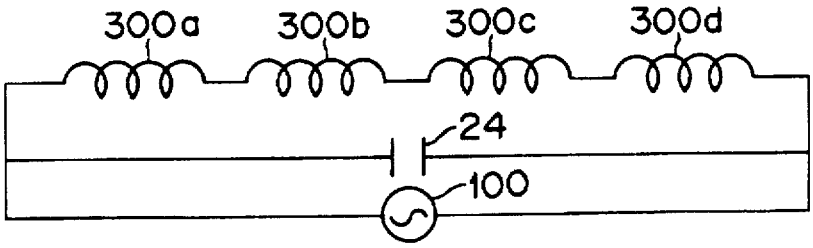
FIG. 13 is a circuit diagram illustrating an induction coil connection for comparison.

In the case of the circuit shown in FIG. 13, the oscillation frequency f calculated in accordance with the formula (A) is found to be 6.8 kHz, a frequency which falls in the audio frequency band. In contrast, the oscillation frequency f is 22.2 kHz in the circuit shown in FIG. 6 and 41.4 kHz in the circuit shown in FIG. 7, both embodying this invention. The oscillation frequencies in the circuits embodying this invention both deviate from the audio frequency band. In the other circuits embodying this invention, when such induction coils as produce a fixed ampere turn are used, the oscillation frequencies to be generated are invariably high enough to deviate from the audio frequency band because the inductance of the induction coil is lowered owing to the parallel connection as compared with the serial connection. In executing this invention, it suffices to set the oscillation frequency at a level in the optimum range, preferably 20 kHz–40 kHz, by combining the number of induction coils to be parallelly connected and the form of connection as already described through the medium of the capacity of the resonance capacitor and the necessary ampere turn.

EXAMPLE 2

Example 2 constitutes one example of the fixing apparatus possessed of a heating apparatus having a plurality of induction coils parallelly connected as described in Example 1 above.

Figure 14:
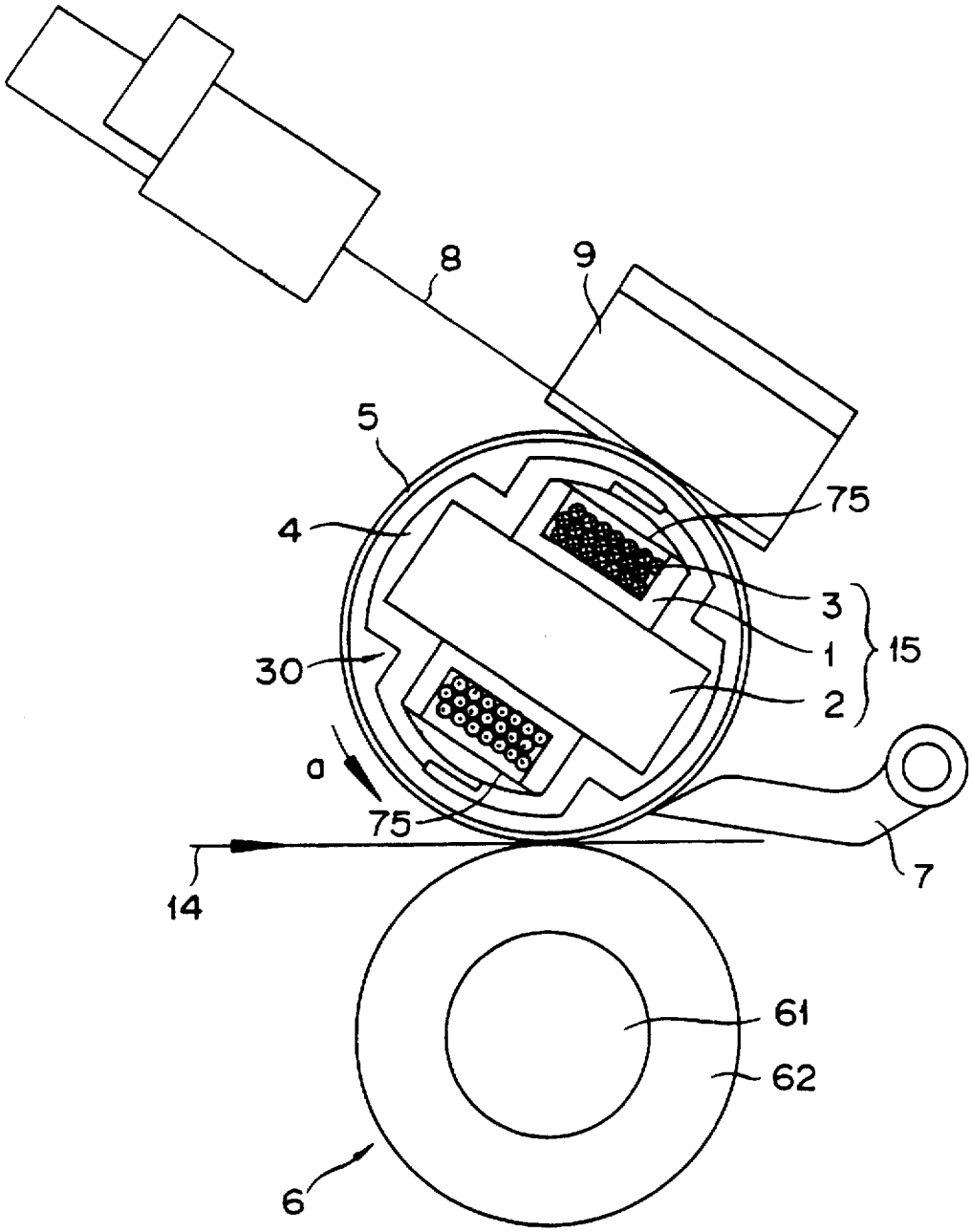
FIG. 14 is a cross section illustrating the fixing apparatus of Example 2 embodying the present invention.
Figure 15:
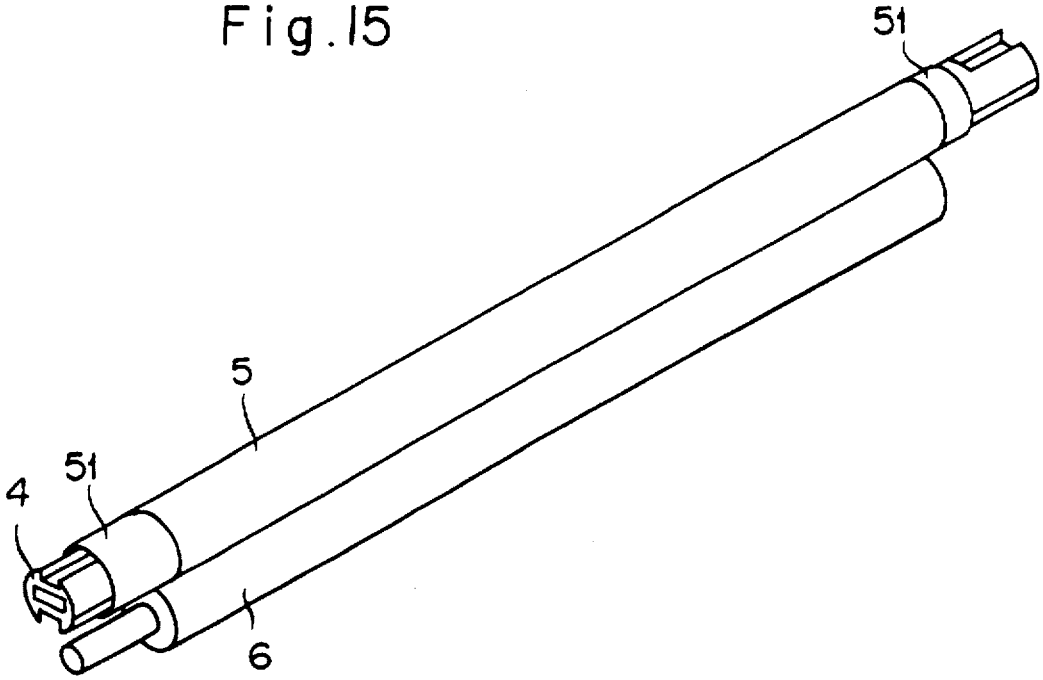
FIG. 15 is a perspective view illustrating the fixing roller and the pressing roller shown in FIG. 14.
Figure 16:
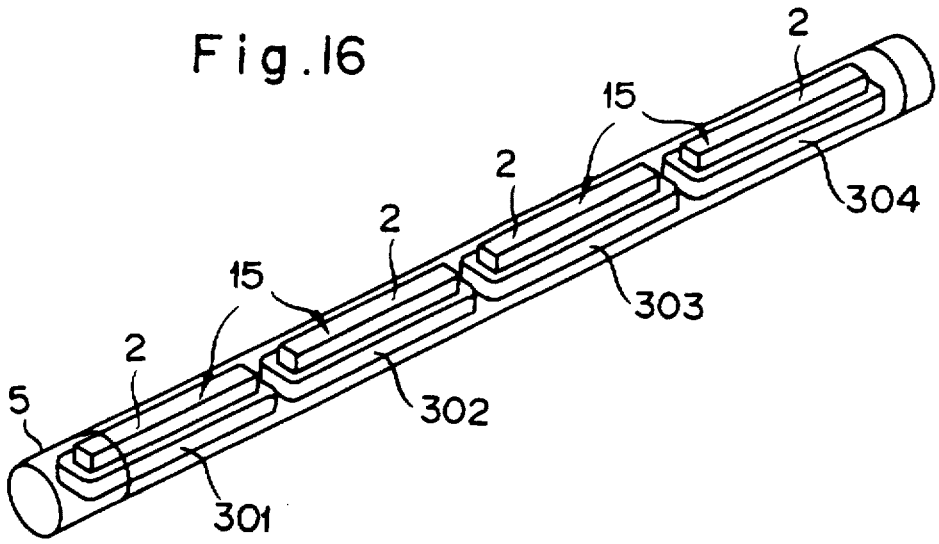
FIG. 16 is a perspective view for aiding in the description of the fixing roller shown in FIG. 14.

FIG. 14 is a schematic cross section illustrating an induction-heating fixing apparatus embodying this invention, FIG. 15 is a schematic perspective view illustrating a fixing roller and a pressing roller used in the apparatus, and FIG. 16 is a perspective view of the fixing roller used in the apparatus.

As illustrated in FIG. 14, the induction-heating fixing apparatus which is incorporated as in a printer, for example, is provided with a fixing roller 5 disposed so as to be rotated in the direction of an arrow a and a pressing roller 6 pressed against the fixing roller 6 and consequently enabled to follow the rotation of the fixing roller 5. The fixing roller 5 is a conductive cylindrical hollow pipe and has disposed therein as shown in FIG. 16 four coil assemblies 15 adapted for enabling the fixing roller 5 to generate an induced current. The induction coils 301, 302, 303, and 304 severally of the coil assemblies 15 are parallelly connected. The coil assemblies 15 are stowed in a holder unit 4 which is fixed as separated from the fixing roller 5 by a slight gap for allowing free rotation of the fixing roller 5. Owing to the parallel connection of the plurality of induction coils in the manner described above, the oscillation frequency in the present fixing apparatus is allowed to fall outside the audio frequency band similarly to the fixing apparatus of Example 1.

Figure 17:
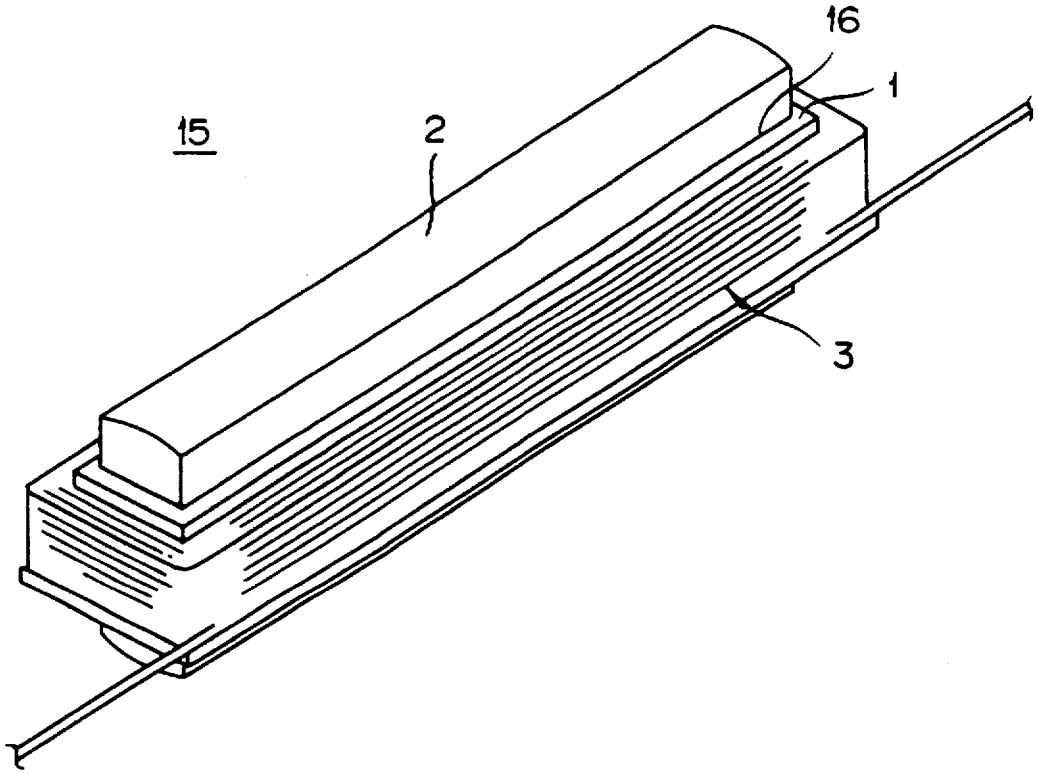
FIG. 17 is a perspective view for aiding in the description of the coil assembly shown in FIG. 14.

The coil assemblies 15 each comprise a core 2, a bobbin 1 containing a through hole 16, and an induction coil 3 formed by winding a copper wire round the bobbin 1 (hereinafter the term "induction coil 3" used in Example 2 will refer individually or collectively to the induction coils 301–304) as shown in FIG. 17. The core 2 is inserted in the through hole 16 of the bobbin 1 and the induction coil 3 is formed by winding a copper wire round the bobbin 1 so as to encircle the core 2.

The core 2 is a ferrite core or a laminated core, for example. The bobbin 1 is formed of a ceramic substance or a heat-resistant insulating engineering plastic substance and fulfills the role of pressing the induction coil 3 and adjusting the shape thereof. The induction coil 3 is produced by winding a single wire or a Litz wire, 0.8 mm in diameter, provided on the surface thereof with a fused layer and an insulating layer round the bobbin 1 in the direction along the rotary axis of the fixing roller 5.

Figure 18:
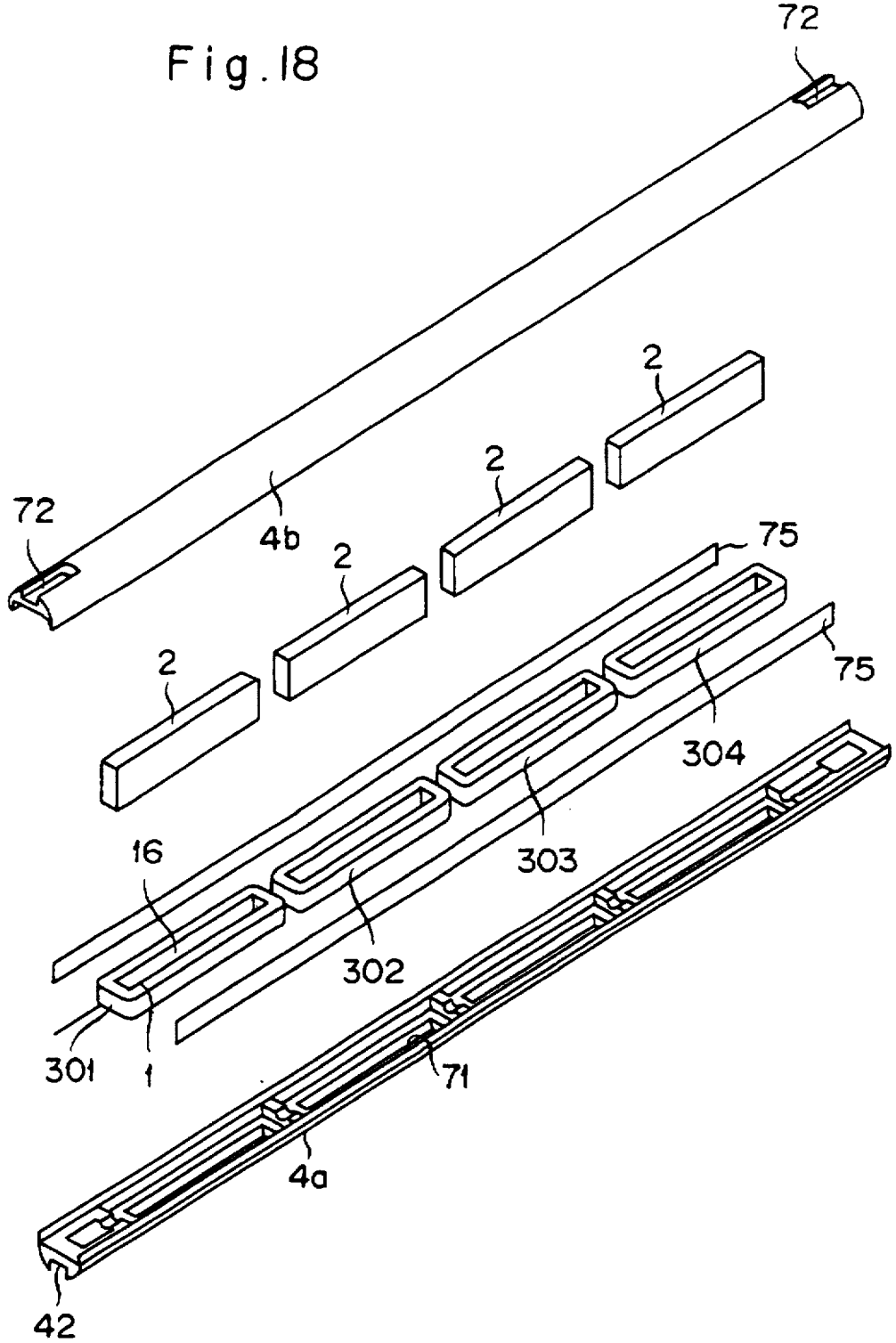
FIG. 18 is an exploded perspective view for aiding in the description of the holder unit shown in FIG. 14.

The holder unit 4 for accommodating the coil assembly 15, as illustrated in FIG. 18, is composed of a holder stay 4*a* and a holder cover 4*b* to be fitted to the holder stay 4*a*, both formed of a heat-resistant insulating engineering plastic substance. The holder stay 4*a* and the holder cover 4*b* have formed on the inner surfaces thereof depressed parts 71 for holding the coil assembly 15 and in the opposite terminal parts thereof slipping parts 72 for fixing the holder unit 4 to the fixing unit frame of the apparatus proper. The holder unit 4 is completed by inserting the bobbin 1 having parallelly connected induction coils 301, 302, 303, and 304 wound thereon in the depressed part 71 formed in the holder stay 4*a*, inserting the cores 2 in the through holes 16 of the bobbin 1, disposing an insulating film 75 on the peripheries of the induction coils 301, 302, 303, and 304, and fitting the holder cover 4*b* to the holder stay 4*a*. The holder unit 4 is formed of a heat-resistant insulating material such as, for example, polyphenylene sulfide (PPS) or liquid crystal polymer.

The fixing roller 5 is formed of such a conductive member as, for example, a carbon steel tube, stainless alloy tube, or aluminum alloy tube and has formed on the circumferential surface thereof a heat-resistant releasable layer obtained by coating the surface with such a fluorine resin as polyethylene tetrafluoride (PTFE). Preferably the fixing roller 5 is formed of conductive magnetic members. The pressing roller 6 has a silicone rubber layer 62, a surface-release type heat-resistant rubber layer, formed on the periphery of an axial core 61. The fixing roller 5 is provided, in the part toward which the sheet 4 is discharged from the fixing roller 5, with a separation claw 7 so disposed as to have the leading part thereof slide on the surface of the fixing roller 5 and peel the sheet 14 from the fixing roller 5.

The fixing roller 5 has slider bearing parts 51 formed one each at the opposite terminals thereof and is rotatably fixed to the fixing unit frame. Further, the fixing roller 5 has a drive gear (not shown) fixed at one end thereof and is rotated by a drive source such as a motor (not shown) connected to the drive gear. The holder unit 4 is stowed inside the fixing roller 5 as separated by the minimum gap of a prescribed size from the inner wall surface of the fixing roller 5 and is fixed to the fixing unit frame and consequently rendered non-rotatable. The slider bearing 51 and the separation claw 7 are formed of a heat-resistant slidable engineering plastic substance.

Above the fixing roller 5, a temperature sensor such as, for example, a thermistor 8 for detecting the temperature of the fixing roller 5 is disposed. This thermistor 8 is held in contact with the surface of the fixing roller 5 as opposed to the lateral surface of the induction coil 3 across the fixing roller 5. The flow of current to the induction coil 3 is controlled so as to optimize the temperature of the fixing roller 5, which is monitored by the thermistor 8 meanwhile. Besides the thermistor 8, a thermostat 9 for breaking the flow of current to the induction coil 3 on detecting an abnormal rise of temperature is provided as a safeguard against the abnormal temperature elevation.

The induction-heating fixing apparatus which is constructed as described above operates as follows.

First, the sheet 14 to which an unfixed toner image has been transferred is conveyed from the left direction in the bearings of FIG. 14 and forwarded in the direction of a nip part between the fixing roller 5 and the pressing roller 6. The sheet 14 is conveyed in the nip part as simultaneously exposed to the heat of the fixing roller 5 which is heated by the principle to be specifically described below and to the pressure produced jointly by the two rollers 5 and 6. As a result, the unfixed toner is fixed and the fixed toner image is formed on the sheet 14. The sheet 14 which has passed through the nip part is spontaneously separated from the fixing roller 5, forcibly separated from the fixing roller 5 by means of the separation claw 7 or a separation guide, and conveyed in the right direction in the bearings of FIG. 14. The sheet 14 is conveyed by a paper discharging roller (not shown) and released onto a paper discharge tray.

Figure 19:
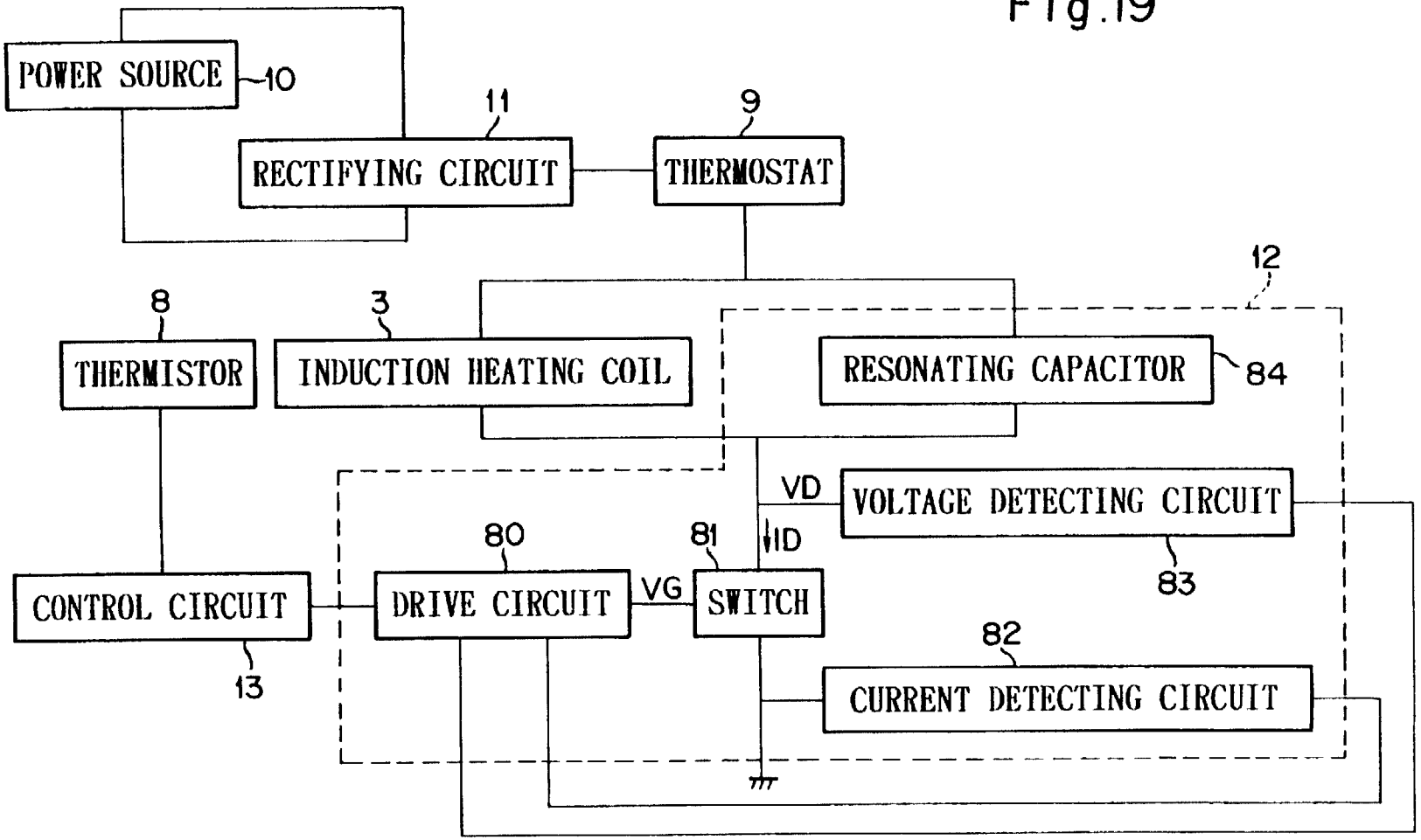
FIG. 19 is a block diagram for aiding in the description of an induction-heating fixing apparatus embodying this invention.

Then, the control system of this fixing apparatus will be described. FIG. 19 is a block diagram of the control system of the fixing apparatus.

The high-frequency current is produced by causing the alternating current of a commercial power source 10 to be rectified by means of a rectifying circuit 11 and the rectified current to be converted into a high frequency by means of a self-exciting inverter circuit 12. The current to the induction coil 3 is supplied via the thermostat 9 pressed against the surface of the fixing roller 5. The circuit of this current is broken by the thermostat 9 when the surface temperature of the fixing roller 5 has reached an abnormal temperature set in advance.

A control circuit 13 is formed of a microprocessor and a memory and adapted to control the temperature of the fixing roller 5 by monitoring this temperature based on the potential of the thermistor 8 and emitting an ON/OFF signal in response to the monitor to a drive circuit 80 laid inside the inverter circuit 12.

The inverter circuit 12 receives the DC current from the rectifying circuit 11, converts it into a high-frequency current, and supplies the high-frequency current to the induction coil 3.

Figure 11:
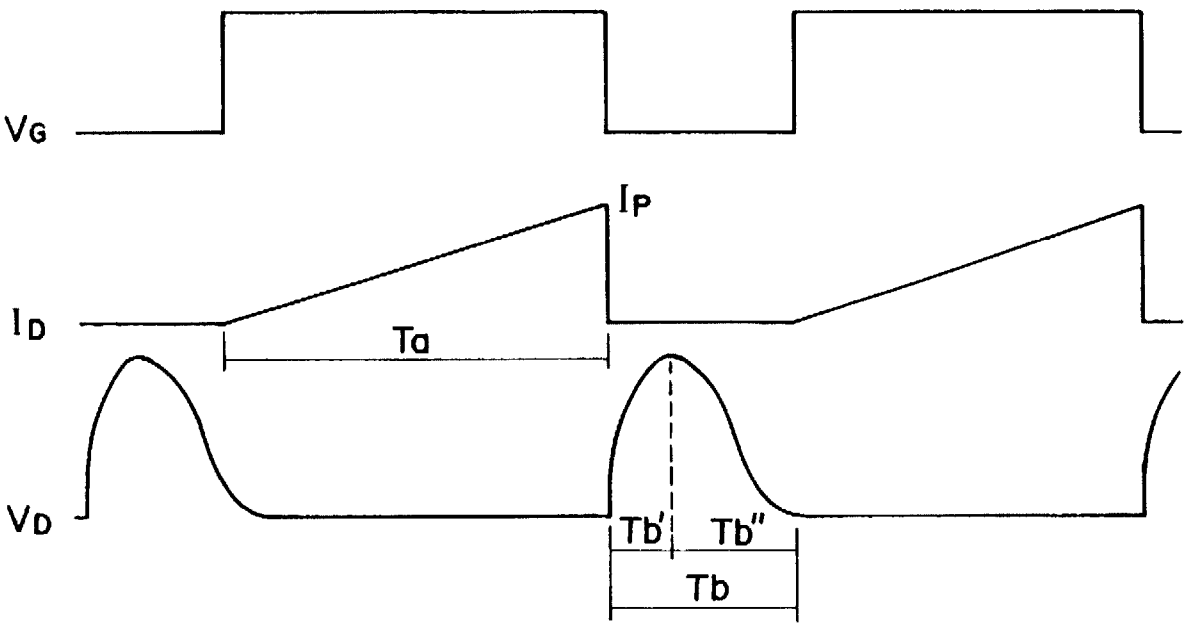
FIG. 11 is a diagram illustrating the current-voltage waveform produced during the heating of a fixing roller.

In the inverter circuit 12, when the control signal (heating signal) issued from the control circuit 13 changes to the status of ON, the drive circuit 80 turns on a switching element 81 formed of a transistor, FET, or IGBT and consequently starts the flow of current to the induction coil 3. Meanwhile, a current detecting circuit 82, on detecting the fact that the current has reached the prescribed value, Ip, issues to the drive circuit 80 a signal for turning off the switching element 81. The waveform of a drain current $I_D$ flowing to the induction coil 3 and detected by the current detecting circuit 82 is shown in FIG. 11 as already described in Example 1 above. A resonance current flows between the induction coil 3 and a resonance capacitor 84 when the switching element 81 is turned off. Then, a voltage detecting circuit 83, on detecting the fact that the drain voltage $V_D$ on the induction coil 3 side of the switching element 81 has fallen to the neighborhood of 0 V in consequence of the resonance, issues to the drive circuit 80 a signal for turning the switching element 81 on again. Thereafter, the flow of the high-frequency current to the induction coil 3 is continued by repeating the switching cycle described above. The waveform of the voltage $V_D$ detected by the voltage detecting circuit 83 and the ON/OFF signal $V_G$ of the switching element 81 (the ON/Off signal of the gate in the case of FET, for example) are as shown in FIG. 11.

When the current of high frequency (several kHz—some tens of kHz) is consequently flown to the induction coil 3, the fixing roller 5 generates heat in conformity with the principle which will be specifically described hereinafter and effects the fixation of the toner image on the sheet (recording medium) 14.

Figure 20:
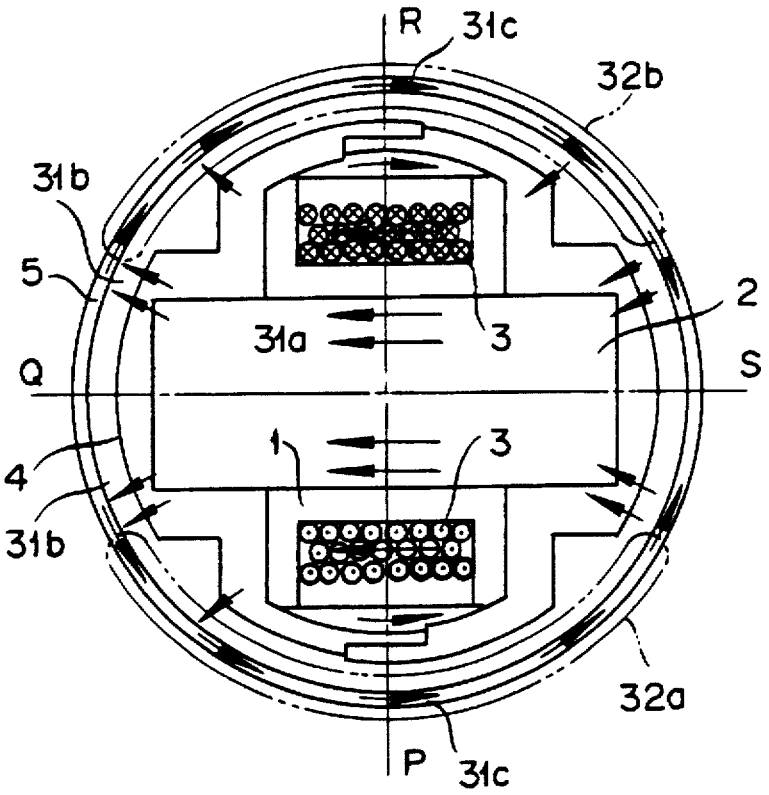
FIG. 20 is a diagram for aiding in the description of the principle of induction heating of a fixing roller.

FIG. 20 is a diagram for aiding in the description of the principle of heating of the fixing roller 5 which is used in the induction-heating fixing apparatus. When the current of high frequency (several kHz—some tens of kHz) is flown to the induction coil 3, the core 2 emits a magnetic flux 31*a* in a direction perpendicular to the direction of the longitudinal axis of the fixing roller 5 as shown in the diagram in compliance with the "ampere's corkscrew rule." This magnetic flux 31*a* is also a high-frequency magnetic flux.

The magnetic flux 31*b*, on arriving at the fixing roller 5 of conductive members, is bent along the fixing roller 5 and converted into a magnetic flux 31*c* which passes along the inner wall surface of the fixing roller 5 at a ratio which depends on the specific permeability of the conductive members. The magnetic flux 31*c* which is concentrated on the circumferential surface of the fixing roller 5 shows the maximum density in the part opposed to the induction coil 3.

In the structure under discussion, the magnetic flux density within the circumferential surface is maximized at points P and R and conversely minimized at points Q and S of the fixing roller 5. Since the density of the induced current assumes the same trend, therefore, the generation of heat in the fixing roller 3 is not uniform throughout the entire circumferential surface. The fixing roller 5 generates heat locally in parts 32*a* and 32*b* which are enclosed with an alternate one-dash two-dot line. The parts 32*a* and 32*b* for the local heating correspond to the upper and the lower part of the fixing roller 5 in the diagram of FIG. 14. The nip part and either of the parts (areas) of heat generation, therefore, overlap at least partly. The other part (area) of heat generation is allowed to contact the thermistor 8 owing to the structure. Incidentally, the position for seating the thermistor 8 may be either in the upper part or in the lower part of the fixing roller 5, whichever better suits the occasion. In the illustrated embodiment, the thermistor 8 is seated outside the upper part. When the thermistor 8 is a miniature product, it may be seated inside the upper part or inside the lower part of the fixing roller 5.

Owing to the action of the magnetic flux 31*c* which is concentrated as described above, the fixing roller 5 generates inside the wall surface thereof such an eddy induced current as produces a magnetic flux directed opposite the magnetic flux 31*c* and suffered to obstruct this magnetic flux 31*c* in accordance with the "Lenz's rule". Since this induced current is converted by the skin resistance of the fixing roller 5 into a Joule heat, the fixing roller 5 generates heat and consequently effects the fixation of the toner image on the sheet 14 as described above.

EXAMPLE 3

Figure 21:
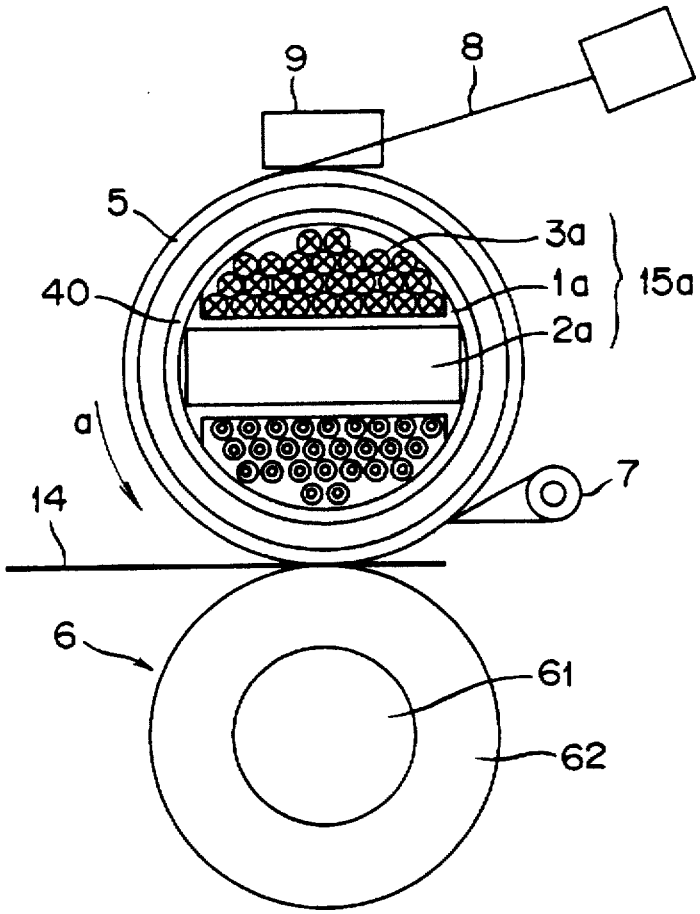
FIG. 21 is a cross section illustrating a fixing apparatus of Example 3 embodying this invention.
Figure 22:
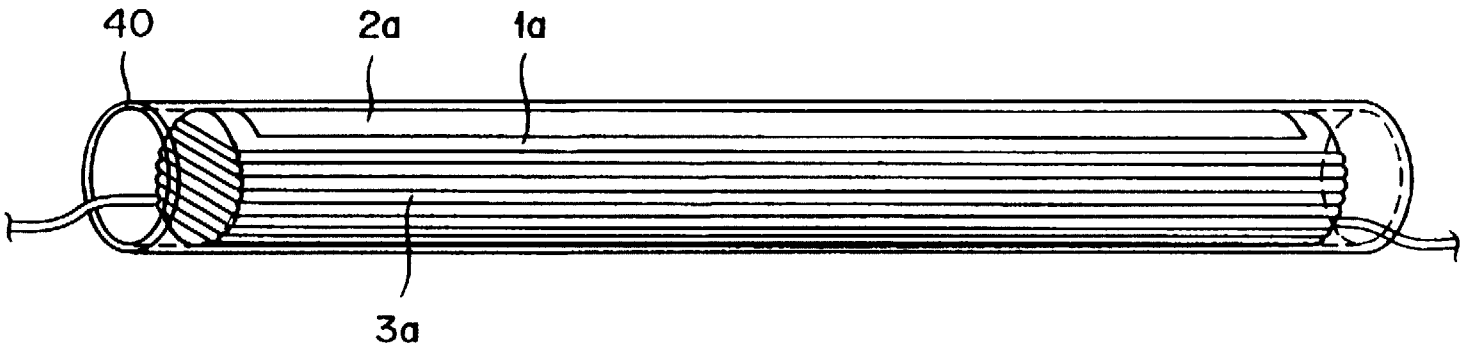
FIG. 22 is a perspective view illustrating a coil assembly in the fixing roller shown in FIG. 21.
Figure 23:
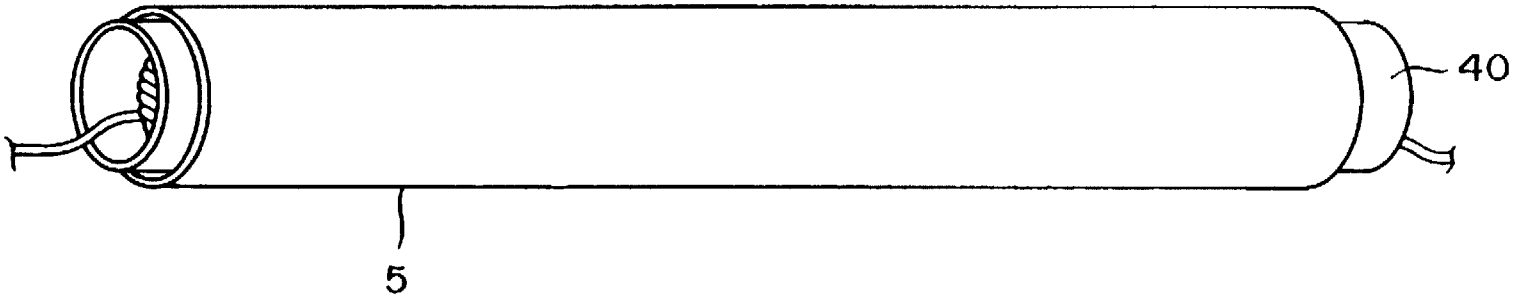
FIG. 23 is a perspective view of the fixing roller shown in FIG. 21.

FIG. 21 is a cross section illustrating another embodiment of the induction-heating fixing apparatus embodying the present invention, FIG. 22 is a perspective view for aiding in the description of a coil assembly, and FIG. 23 is a perspective view of a fixing roller. Example 3 differs from Example 2 in the manner of winding the induction coil and in the structure of the induction coil. In all the other particulars of structure, these two examples are identical. The structure and the operation which are identical to those of Example 2, therefore, will be omitted from the following description.

The induction-heating fixing apparatus of Example 3, as illustrated in FIG. 21, is provided with a fixing roller 5 which is disposed rotatably in the direction of an arrow a and a pressing roller 6 pressed against the fixing roller 5 and allowed to follow the rotation of the fixing roller 5. The fixing roller 5 is a cylindrical hollow pipe formed of conductive members. A coil assembly 15*a* for causing the fixing roller 5 to produce an induced current is disposed inside the fixing roller 5 along the direction of the axis of rotation (direction of the axis of the cylinder).

The coil assembly 15*a*, as illustrated in FIG. 22 and FIG. 23, is provided inside the fixing roller 5 with one core 2*a* elongate in the direction of the axis of the fixing roller 5, a bobbin 1*a* disposed so as to encircle the core 2*a*, and an induction coil 3*a* formed by winding a copper wire round the bobbin 1*a*. This coil assembly 15*a* is encased in a cylindrical holder 40 and stowed ultimately inside the fixing roller 5.

The holder 40 is formed of a heat-resistant insulating material such as, for example, PPS (polyphenylene sulfide) or a liquid crystal polymer.

The core 2*a* is formed of a ferrite core or a laminated core, for example.

The bobbin 1*a* is formed of a ceramic substance or a heat-resistant insulating engineering plastic substance and is intended to fulfill the role of pressing at least the lowest layer part of the induction coil 3*a* approximating most closely to the core 2*a* and adjusting the shape of the induction coil 3*a*. This bobbin 1*a* has practically the same width as the core 2*a* so that in the lowest layer part near the core 2*a*, the induction coil 3*a* may be wound in the largest possible number of turns.

The induction coil 3*a* is produced by winding a single wire or a Litz wire, 0.8 mm in diameter, provided on the surface thereof with a fused layer and an insulating layer round the bobbin 1*a* in the direction along the rotary axis of the fixing roller 5. The induction coil 3*a* is so wound that the numbers of turns gradually decrease from the lowest layer approximating most closely to the core 2*a* to the upper layers. The induction coil 3*a*, therefore, winds along the circumference of the holder 40 and fills the inner empty space substantially completely.

When the induction coil 3*a* is so wound that the numbers of turns thereof decrease from the lowest layer to the upper layers as described above, the induction coil to be used is allowed to have a greater thickness than when the induction coil is wound in one same number of turns in all the layers. When an induction coil having the same ampere turn as is contemplated by Example 3 is to be obtained by winding the coil with one same number of turns in all the layers, for example, the thickness of the induction coil must be decreased to about 0.5 mm, a size smaller than in Example 3.

Since the use of an induction coil of a greater thickness is allowed as mentioned above, it is made possible to reduce the copper loss of the induction coil, decrease the amount of heat generated by the induction coil during the flow of current, and prevent the temperature of the fixing roller 5 from excessively rising.

The relation between the copper loss and the thickness of the induction coil offers a clear explanation for the advantages just mentioned. The following formulas (1) and (2)

represent the relation between the copper loss and the thickness of the induction coil.

$$P=I^2R \quad (1)$$

$$R=\rho \cdot L/S \quad (2)$$

(wherein P represents the copper loss, I the current flown to the induction coil, R the resistance of the copper loss, ρ the resistivity of the copper wire destined to form the induction coil, L the length of the copper wire destined to form the induction coil, and S the cross section of the copper wire destined to form the induction coil).

From the formulas given above, it is clearly noted that the copper loss of the induction coil decreases in proportion as the thickness (cross section) of the induction coil (the copper wire destined to form the induction coil) increases. The generation of heat in the induction coil, therefore, results in a decrease of the copper loss.

EXAMPLE 4

Figure 24:
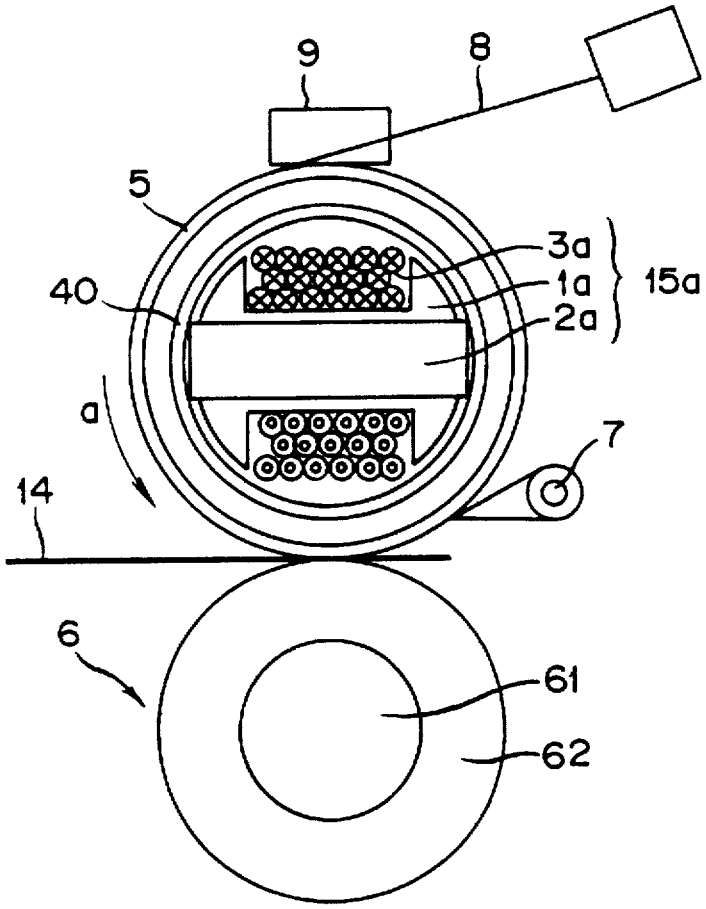
FIG. 24 is a cross section illustrating a fixing apparatus of Example 4 embodying this invention.

FIG. 24 is a cross section illustrating still another example of the induction-heating fixing apparatus embodying the present invention.

Example 4 differs from Example 3 in the manner of winding the induction coil. In all the other particulars of structure, they are identical. Thus, the particulars that characterize Example 4 will be covered in the following description and the structure and the operation that are identical to those of Example 3 will be omitted from the following description.

In the induction-heating fixing apparatus of Example 4, an induction coil 3*a* wound round a bobbin 1 which is disposed so as to encircle a core 2*a* has one same number of turns in almost all the layers from the lowermost layer to the upper layers as shown in FIG. 24. Further, the induction coil 3*a* is given an outside diameter in the range of 0.2–0.8 mm and a plurality of copper wires are bundled to form a Litz wire.

By setting the outside diameter of the induction coil 3*a* in the range of 0.2–0.8 mm as mentioned above, the magnitude of the effective resistance of the induction coil in the induction-heating fixing apparatus to which a high frequency in the approximate range of 10–100 kHz is applied can be minimized, the generation of heat in the induction coil can be decreased to the fullest possible extent, and the fixing roller can be prevented from excessively elevating its temperature. Further, the use of the Litz wire facilitates the production which is implemented by winding the thin induction coil, 0.2–0.8 mm, on a bobbin.

Now, the reason for limiting the outside diameter of the induction coil to the range of 0.2–0.8 mm as described above will be given below.

Between the outside diameter of the induction coil and the generation of heat due to the copper loss of the induction coil, there exists a close relation as described in Example 3 with the aid of the formulas (1) and (2). Simply it is concluded that the resistance is lowered, the loss due to the self-generation of heat is decreased, and consequently the generation of heat in the induction coil is reduced and, at the same time, the proportion of energy to be used for the induction-heating of the fixing roller increases in proportion as the outside diameter of the induction coil increases.

Specifically, when the thickness of one coated copper wire is increased, the copper loss is decreased because the cross section of the copper wire is increased proportionately to the increase in the thickness thereof. At a high frequency, however, the effect in reducing the copper loss is diminished by the skin effect in proportion as the outside diameter of the induction coil is increased. When the thickness is unduly increased, the induction coil 3*a* bulges at the corners of turns as shown in FIG. 25 and is not easily wound tightly on the bobbin 1*a* in terms of production.

When the induction coil is formed with one coated copper wire, the fact that this invention imparts an alternating current of high frequency (10 kHz–100 kHz) to the induction coil brings about the contrary effect that the effective resistance of the copper wire is not appreciably increased for an increase in the cross section of the copper wire owing to the skin effect. This fact implies that the effect derived from increasing the thickness of the copper wire diminishes in proportion as the copper wire gains in thickness. For the sake of decreasing the loss, therefore, it is more advantageous to form the induction coil with a Litz wire resulting from bundling a plurality of a thin coated copper wires than to form the induction coil with one thick coated copper wire.

Figure 25:
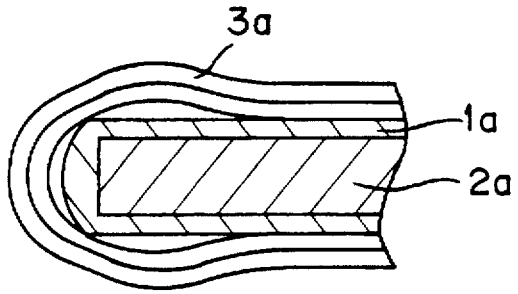
FIG. 25 is a cross section illustrating the state of the terminal part of winding of an induction coil.

The increase in the outside diameter of the copper wire also entails the problem that the induction coil produced by winding the copper wire is not easily stowed in the holder of a stated space because the copper wire bulges at the corners of turns thereof as illustrated in FIG. 25. When a multiplicity of very fine coated copper wires are bundled and are forcibly stowed in the holder of a stated space, the same contrary effect of decrease in loss as mentioned above ensues that the ratio of the copper wire part (the cross section used for the flow of current) to the cross section of the Litz wire is increased by the bulges of bundles, the coating of the copper wire, and the fused layer (which is not always necessary). The attempt proves unfavorable in terms of the cost and the efficiency of production (the size of the holder inside the rotary member generally falls in the range of 10–60 mm as outside diameter).

When the induction coil is formed, as contemplated by this invention, in a limited space of the interior of the rotary member in the fixing apparatus, the optimum outside diameter of the copper wire has its limits. It has been found experimentally that the Litz wire using a copper wire with an outside diameter of not less than 0.2 mm and not more than 0.8 mm is appropriate for the induction coil in terms of efficiency, cost, and ease of production.

Figure 26:
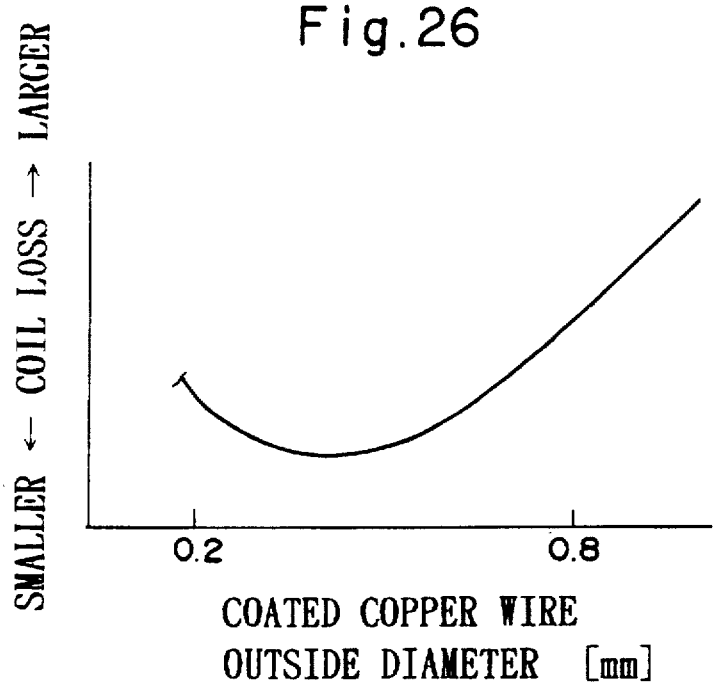
FIG. 26 is a diagram showing the relation between the outside diameter of a coated copper wire and the induction coil loss.

The relation of the induction coil loss to the outside diameter of the copper wire is shown in FIG. 26. It is clearly noted from the diagram that the coil loss unduly increases when the outside diameter of the copper wire is smaller than 0.2 mm or larger than 0.8 mm. Since the ratio of the self-generation of heat in the induction coil increases and the elevation of the temperature of the induction coil also increases as a result, the temperature of the induction coil surpasses the limit of its own heat resistance and the induction coil is required to be made of an expensive material of high grade of heat resistance. Further, the self-generation of heat impairs the efficiency of heating and exerts an adverse effect on the heat resistance of circumferential parts such as of the bobbin.

When the induction coil is to be stowed in a holder, 30 mm in outside diameter, for example, the outside diameter of the copper wire is appropriately in the range of from 0.3 mm to 0.5 mm. When the coated copper wire is unduly thin, the efficiency of bundling is not very high because of the inevitable formation of bulges and the production of the Litz wire grows in difficulty because of the necessity of bundling a multiplicity of coated copper wires. When the holder has a smaller outside diameter, the range of the outside diameter of the copper wire is shifted toward a decreasing direction because of a decrease in the number of wires to be bundled.

Figure 27:
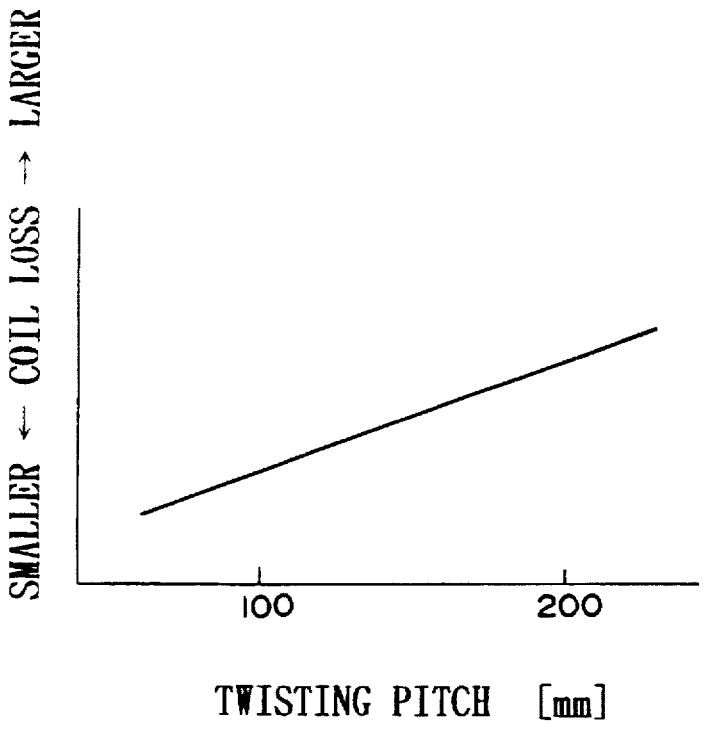
FIG. 27 is a diagram showing the relation between the twist pitch of the induction coil and the induction coil loss.

The minimum magnitude of the coil loss exists in the range, 0.2 mm–0.8 mm, of the outside diameter of the copper wire. The heating of high energy efficiency can be realized by forming the induction coil within this range. In terms of the cost and the efficiency of production, the number of Litz wires to be bundled is appropriately not more than 100. When the Litz wire is formed by bundling a plurality of coated copper wires, it is necessary that the wire be bundled as twisted meantime. The reason for this necessity is that the current flowing through the coated copper wire deviates from one to another ply of the copper wire when the copper wire is wound in an untwisted form on the bobbin. It has been experimentally found that the pitch of this twisting must be kept below 200 mm. The relation between the twisting pitch and the induction coil loss at a fixed frequency is shown in FIG. 27. The induction coil loss is increased by the deviation of the current when the twisting pitch is unduly large. When the twisting pitch exceeds 200 mm, the temperature of the induction coil surpasses the limit of its own heat resistance (generally the limit of heat resistance of the induction coil is about 220° C. at most) similarly to the outside diameter of the copper wire mentioned above.

EXAMPLE 5

Figure 28:
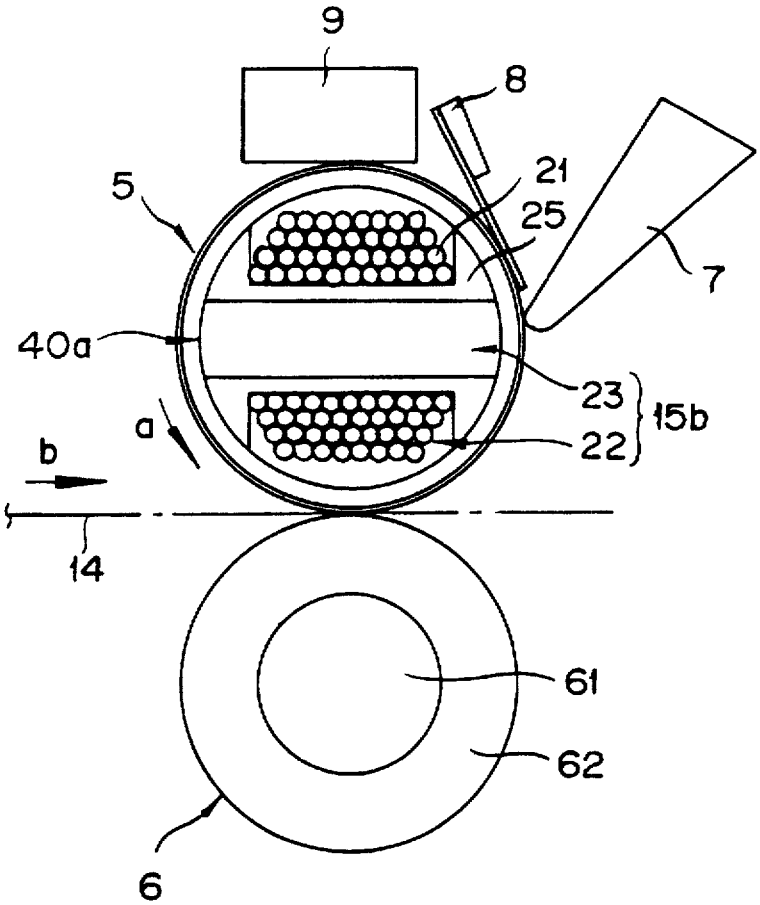
FIG. 28 is a cross section illustrating a fixing apparatus of Example 5 embodying this invention.

FIG. 28 is a cross section schematically illustrating an induction-heating fixing apparatus of Example 5 embodying this invention.

Part of the components of the structure of this example which are identical with those of Example 2, Example 3, and Example 4 will be omitted from the following description.

The fixing apparatus of Example 5, as illustrated in FIG. 28, is provided with a fixing roller 5 and a pressing roller 6 pressed against the fixing roller 5 and consequently allowed to follow the rotation of the fixing roller 5.

The fixing roller 5 is a hollow pipe formed of conductive members. A coil assembly **15*b* is disposed inside the fixing roller 5. This coil assembly 15*b* is retained by a holder 25 and to complete a holder unit 40*a*** as a whole.

The fixing roller 5 is provided at the opposite terminals thereof each with a slider bearing part and it is rotatably attached to a fixing unit frame (not shown). Further, the fixing roller 5 is provided at one of the terminals thereof with a drive gear and is rotated by a drive source such as a motor (not shown) which is connected to the drive gear. The holder 25 is fixed to the fixing unit frame and therefore rendered non-rotatable. It is stowed inside the roller 5 as separated by a gap of a stated size from the inner wall surface of the fixing roller 5.

Then, the fixing roller 5 is provided with a separation claw 7 adapted to make sliding contact with the surface of the fixing roller 5. Above the fixing roller 5, a thermistor 8 for detecting the temperature of the fixing roller 5 and a thermostat 9 as a safeguard against abnormal temperature elevation are disposed. The thermistor 8 and the thermostat 9 are pressed against the surface of the fixing roller 5 so as to be opposed to the induction coil 22 across the fixing roller 5.

The fixing roller 5 is formed of such a conductive member as, for example, a steel tube, stainless alloy tube, nickel tube, carbon steel tube, or aluminum alloy tube and has formed on the circumferential surface thereof a heat-resistant releasable layer obtained by coating the surface with a fluorine resin. The fixing roller 5 preferably is formed of conductive magnetic members. The pressing roller 6 has a silicone rubber layer 62, a surface-release type heat-resistant rubber layer, formed on the periphery of an axial core 61. Then, the slider bearing and the separation claw 7 are formed of a heat-resistant sliding engineering plastic substance.

Figure 29:
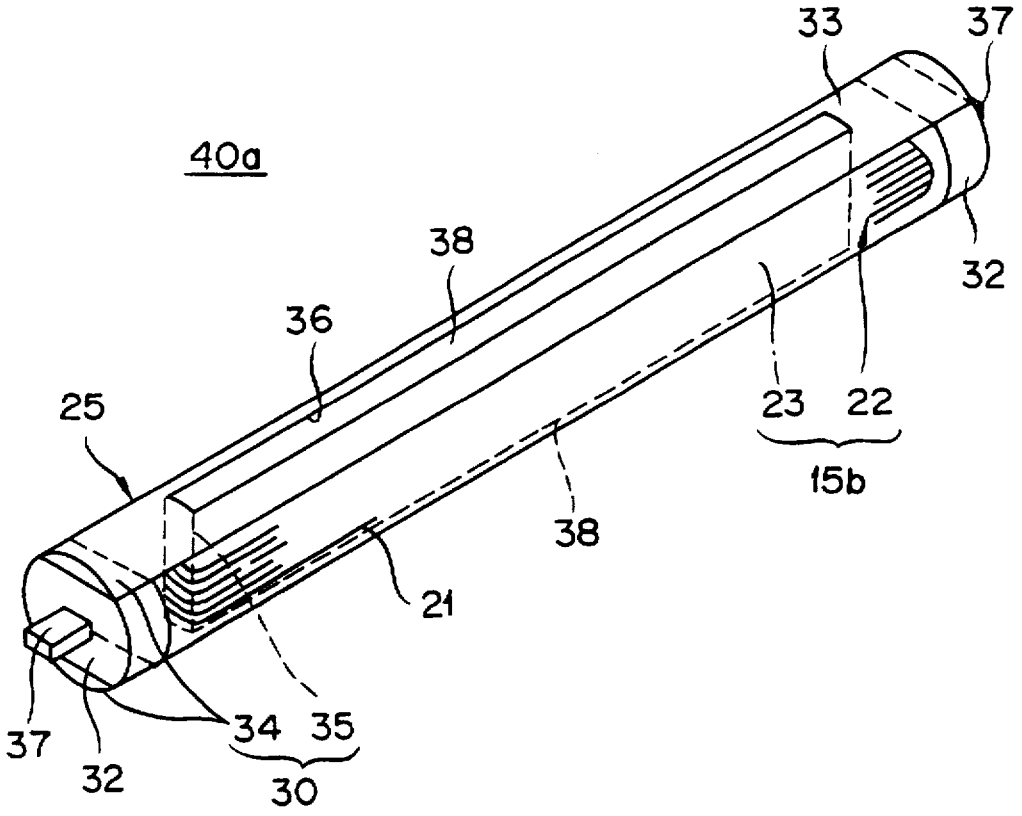
FIG. 29 is a outline perspective view of the holder unit shown in FIG. 28.

The holder unit **40*a*, as illustrated in FIG. 29, is composed of a coil assembly 15*b* and a holder 25 as described above. The coil assembly 15*b* is provided with a core 23 formed of a magnetic material and an induction coil 22 formed by winding a copper wire 21 through the medium of an insulating part round the core 23 and adapted for causing the fixing roller 5 to produce an induced current and generate heat. The core 23 and the induction coil 22 are supported by the holder 25**.

In Example 5 in particular, the holder 25 is provided with an integrating part formed in a substantially cylindrical shape of an electrically insulating material integrally with the holder 25 and adapted to insulate the core 23 from the induction coil 22. The core 23 has formed therein an end face 38 which continues into the circumferential surface 33 of the holder 25.

Figure 30:
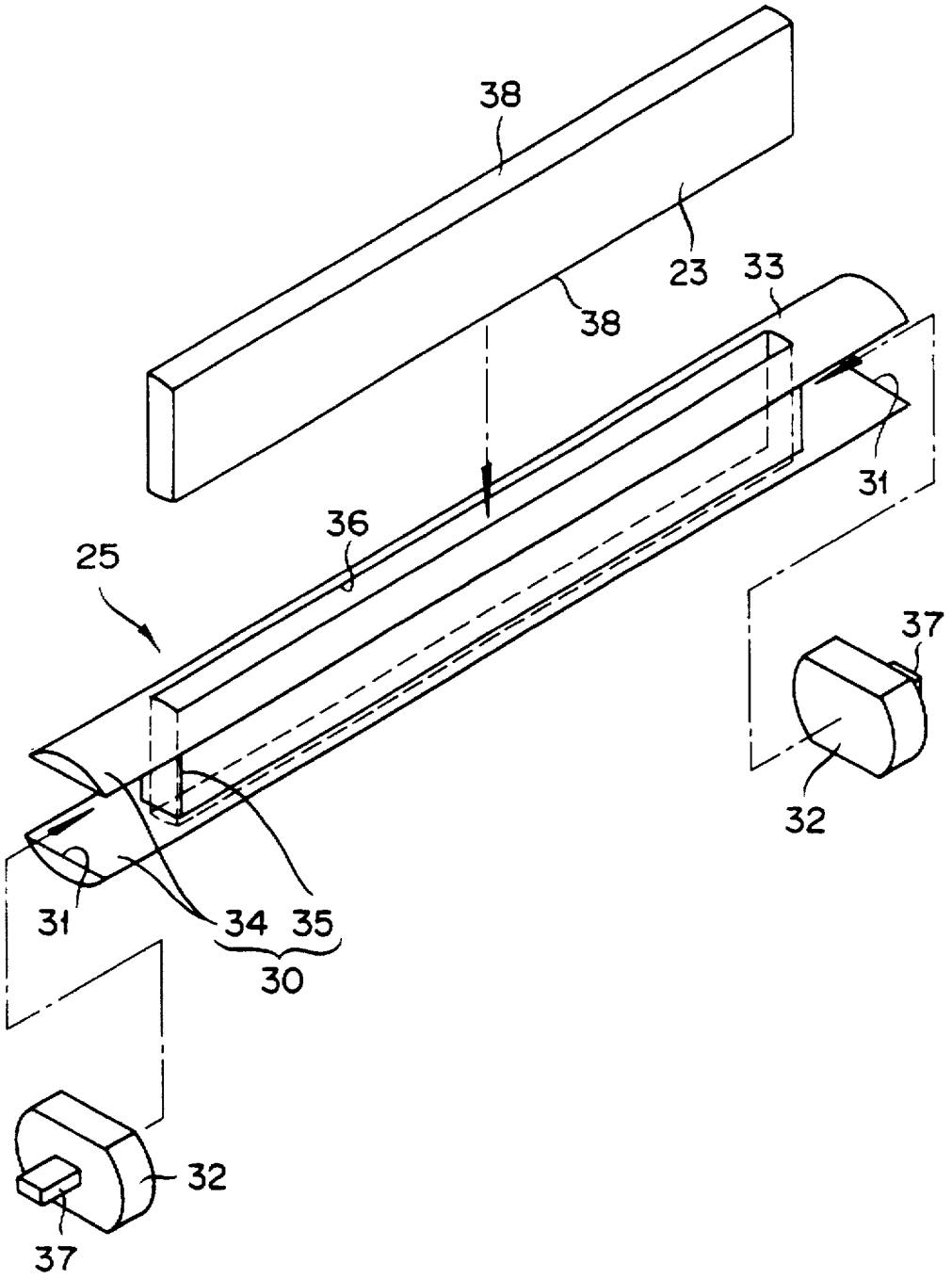
FIG. 30 is an exploded perspective view illustrating a core and a holder of the holder unit mentioned above.

To be more specific, the holder 25, as illustrated in FIG. 30, is provided with a holder proper 30 formed in a substantially cylindrical shape and terminal stoppers 32 adapted to close openings 31 which are provided one each at the opposite terminals in the axial direction of the holder proper 30. The holder proper 30 is composed of arcuate parts 34 seated in the upper and the lower position in the bearings of the diagram and having arcuate outer circumferential surfaces 33 and a rectangular bobbin part 35 extending in the axial direction and serving to connect the arcuate parts 34. In the bobbin part 35, through holes 36 for allowing insertion of the cores 23 are formed through the arcuate parts 34. The holder proper 30 and the terminal stoppers 32 are both formed of a heat-resistant insulating engineering plastic substance. The holder proper 30 has the two arcuate parts 34 and the bobbin part 35 formed integrally therewith. The terminal plugs 32 are each provided with a projecting part 37 to be fixed to the fixing unit frame. The induction coil 22 is formed by winding a copper wire 21 a plurality of turns in one direction round the bobbin part 35. The four wall surfaces of the bobbin 35 function as the insulating part formed integrally on the holder 25 as mentioned above.

Figure 31:
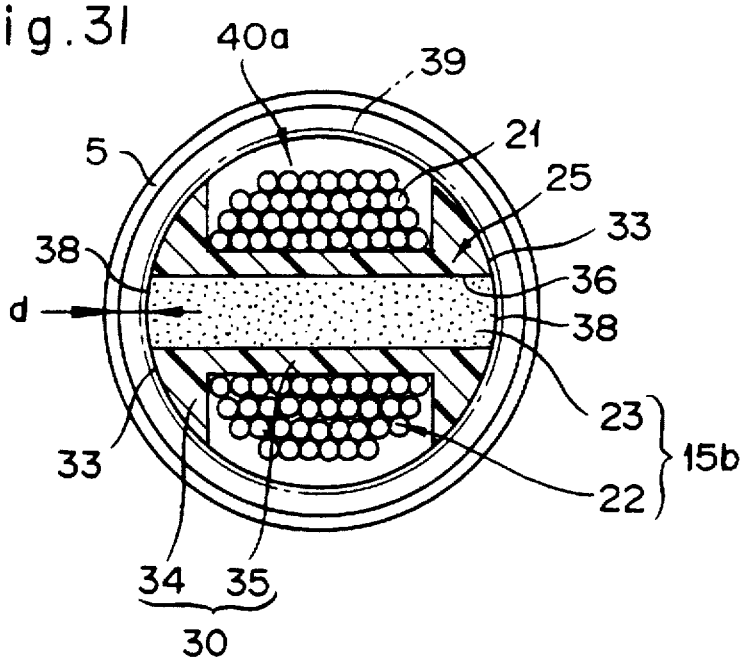
FIG. 31 is a magnified cross section illustrating the essential part of an induction-heating fixing apparatus of Example 5.

The core 23 assumes the shape of a relatively elongate plate. A terminal surface 38 of the core 23 lying along the direction of the opening in the through hole 36, as illustrated on a magnified scale in FIG. 31, has the same radius of curvature as the arcuate circumferential surface 33 of the arcuate part 34 so that, when the core 23 is inserted in the through hole 36 and fixed therein, the terminal surface 38 smoothly continues into the arcuate circumferential surface 33. The core 23 is formed of a ferrite core or a laminated core, for example, and is disposed to intersect perpendicularly the copper wire 21 of the induction coil 22 and allowed to form a magnetic circuit.

FIG. 30 depicts a structure in which the terminal stoppers 32 are fitted to the openings 31 in the holder proper 30 after the induction coil 22 is formed. The terminal stoppers 32 are not essential members for the formation of the holder 25. It is allowable to form on the fixing unit frame such members as fit into the openings 31 and use these members for retaining the holder proper 30. For the induction coil 22, it is appropriate to use a single wire or a Litz wire provided on the surface thereof with a fused layer and an insulating layer. The copper wire 21 is wound within the range not surpassing the circumferential surface of the holder.

Further in Example 5, the holder 25 is wholly enveloped with a heat-resistant electric insulating member 39 of a small wall thickness. The electric insulating member 39 of a small wall thickness is formed of polyimide, polyamideimide, or fluorine resin, for example. Specifically, it is an insulating film or an insulating tube having a thickness in the approximate range of 30 μm–100 μm. The electric insulating member 39 is not limited to a tubular shape. It is only required to be so shaped as to cover at least the portions of the core 23 and the induction coil 22 that are exposed from the holder 25. For example, the electric insulating member formed in the shape of a sheet capable of covering not the holder 25 wholly but the terminal surface 38 of the core 23 and the lateral surface of the induction coil 22 partly may be attached to the arcuate part 34 of the holder proper 30 by adhesion or coating.

The holder 25 is stowed in a non-rotatable state inside the fixing roller 5 and the core 23 is disposed as separated by a distance (hereinafter referred to as "gap") of not less than 0.5 mm and not more than 4 mm from the inner surface of the fixing roller.

The reason for specifying the size of the gap as mentioned above is given below.

The holder 25 supporting the induction coil 22 and the core 23 is stowed in the fixing roller 5 and is fixed at the opposite terminals thereof to the fixing unit frame. Thus, it sags to a certain extent under the weight of the induction coil 22 and that of the core 23. The possibility exists that the fixing roller 5 and the holder 25 will suffer from such dimensional dispersions as are not infrequently observed in articles of manufacture, i.e. the former having its inside diameter and the latter its outside diameter fluctuate. All these factors considered, the gap must be kept above 0.5 mm. The amount of the sag which the holder 25 produces depends, though not entirely, on the length thereof. So long as the gap has the maximum size of 4 mm, the possibility of the core 23 colliding against the fixing roller 5 is nil, even in consideration of the dimensional dispersions of relevant parts.

Figure 32:
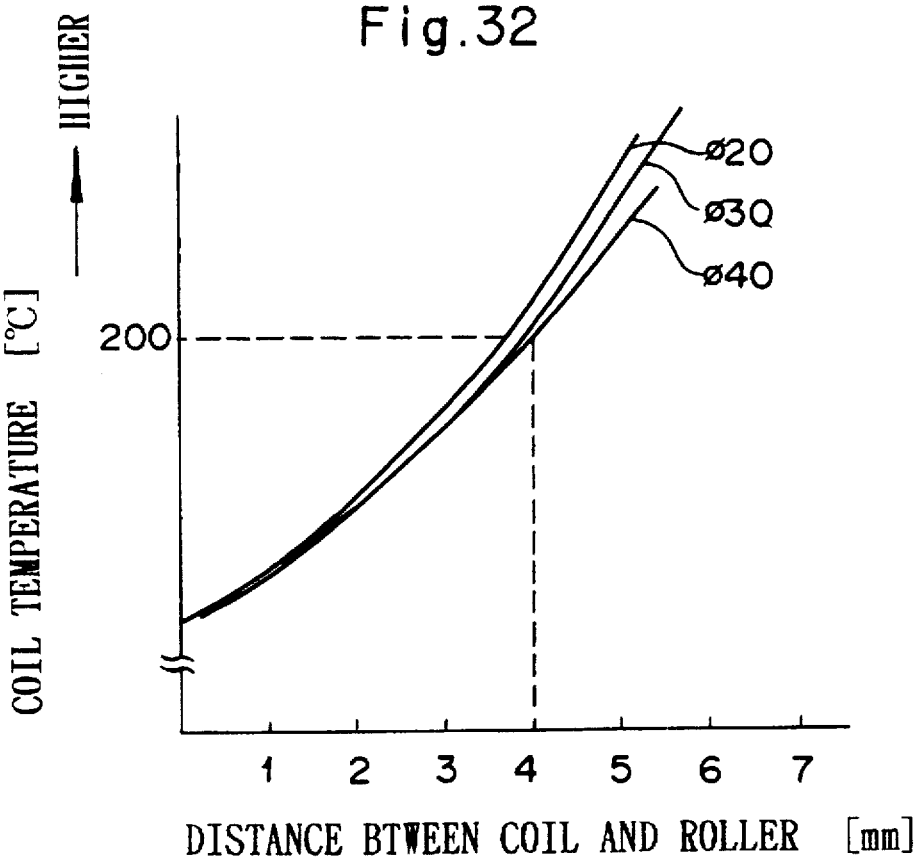
FIG. 32 is a graph showing the relation between the distance from the fixing roller to the core and the temperature of the induction coil.

When the size of the gap increases, the efficiency of heating is degraded and the amount of the current flown to the induction coil must be increased. FIG. 32 is a graph showing the relation between the distance from the fixing roller to the core and the temperature of the induction coil. It is noted from this diagram that the amount of heat generation due to the copper loss of the induction coil is fairly increased when the gap exceeds 4 mm. The temperature of the induction coil itself exceeds 200° C., for example, when the temperature of the fixing roller is 160° C. In this case, the power applied is 160 W for the roller of an outside diameter of 20 mm, 300 W for the roller of an outside diameter of 30 mm, and 700 W for the roller of an outside diameter of 40 mm. When the temperature of the induction coil itself exceeds 200° C., an expensive material capable of enduring the temperature mentioned above must be used for the holder for supporting the core and the induction coil or for the induction coil. The use of this material not merely entails an addition to the cost but also counters the trend toward energy conservation.

In view of the points mentioned above, it is safe to conclude that the temperature of the induction coil can be kept below 200° C. by giving the gap a size of not more than 4 mm and the core can be prevented from colliding against the fixing roller and the fixing roller can be safely rotated by giving the gap a size of not less than 0.5 mm.

The induction-heating fixing apparatus of Example 5 which specifies a size of not more than 4 mm for the gap, therefore, can prevent the cost from increasing and contribute to the conservation of energy. Further, by specifying a size of not more than 0.5 mm for the gap, the fixing apparatus can ensure smooth rotation of the fixing roller 5 and secure electric insulation between the core 23 and the fixing roller 5. Further, since the holder 25 is wholly enveloped with an electric insulating member 39 such as an insulating film or insulating tube, the electric insulation between the core 23 and the fixing roller 5 and between the induction coil 22 and the fixing roller 5 can be further ensured. Even when the coating of the induction coil 22 is broken as by excessive temperature elevation, for example, the electric insulation can be infallibly secured and the fixing apparatus can be prevented from being wholly fractured.

Incidentally, the fixing apparatus incorporated in a copying device or a printer generally uses a fixing roller having an outside diameter in the approximate range of 10 mm–60 mm. The necessity of enlarging the outside diameter of the fixing roller for the purpose of securing an ample nip width for heating paper grows in proportion as the number of pages to be printed per unit time or the speed of printing operation increases. When the outside diameter of the fixing roller is large, the coil assembly of the holder unit can be proportionately enlarged. Since this enlargement results in an increase in the power required for the operation, the situation of the elevation of the temperature of the induction coil is substantially invariable without reference to the outside diameter of the roller as shown in FIG. 32. This fact indicates that the elevation of the temperature of the induction coil is copiously affected by the size of the gap rather than the outside diameter of the roller. The fixing apparatus which uses a fixing roller having an outside diameter departing from the range mentioned above, therefore, requires to use a size of not more than 4 mm for the gap without reference to the outside diameter of the fixing roller. The results of other experiments indicate that, in spite of the difference in material of the fixing roller, the size of the gap notably affects the elevation of the temperature of the induction coil rather than the difference in material.

Figure 33:
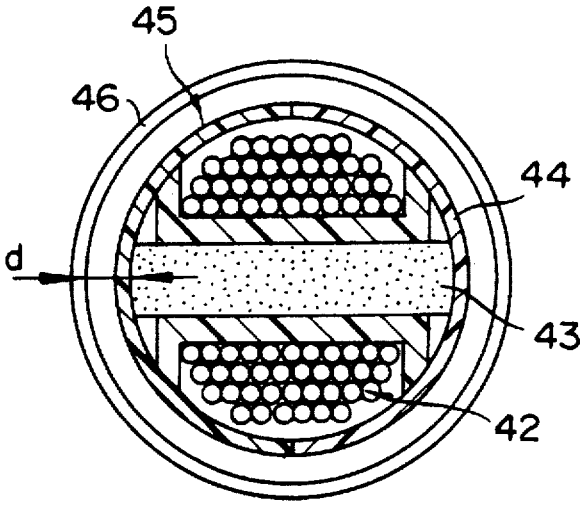
FIG. 33 is a magnified cross section illustrating the essential part of an induction-heating fixing apparatus using a comparative holder unit.

Incidentally, in the structure in which a holder unit 45 having a core 43 and an induction coil 42 wholly enveloped with a holder 44 is stowed in a fixing roller 46 as illustrated in FIG. 33, when the distance between the outer circumferential surface of the holder 44 and the inner circumferential surface of the fixing roller 46 is the same as is contemplated by Example 5, the core 43 is fated to be separated from the inner surface of the fixing roller 46 by a distance equalling the thickness of the holder 44. An idea of decreasing the wall thickness of the holder 44 and consequently allowing the core 43 to approximate to the inner surface of the fixing roller 46 may be conceivable. This measure, however, causes a shortage of the mechanical strength for fixing the holder unit 45 to the fixing unit frame.

In contrast, Example 5 can secure ample mechanical strength of the holder 25 as a whole by integrating the bobbin part 35 with the holder proper 30 and can cause the core 23 to approximate to the inner surface of the fixing roller 5 to the fullest possible extent by enabling the terminal surface 38 of the core 23 to continue to the arcuate outer circumferential surface 33 of the holder proper 30. Moreover, since the holder 25 is wholly enveloped with an electric insulating member 39 of a thin wall such as an insulating film or insulating tube, the present embodiment can secure an ample electric insulation even when the core 23 is approximated more closely to the inner surface of the fixing roller 5.

EXAMPLE 6

Figure 34:
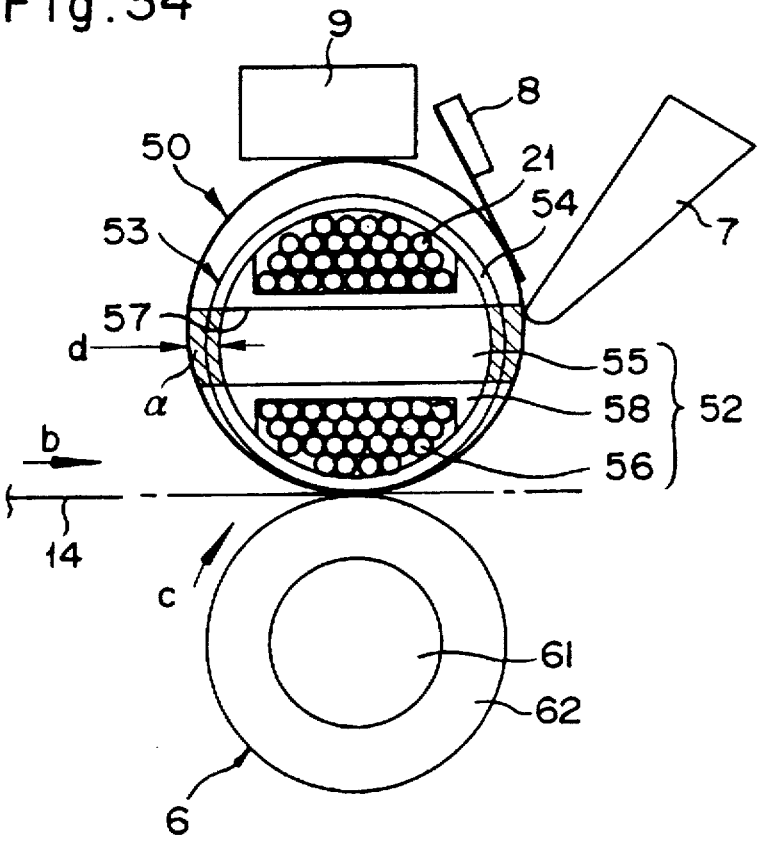
FIG. 34 is a cross section illustrating a fixing apparatus of Example 6 embodying this invention.

FIG. 34 is a cross section schematically illustrating an induction-heating fixing apparatus of Example 6 embodying this invention. In this diagram, like parts found in Example 5 will be denoted by like reference numerals and will be omitted from the following description.

Example 6 differs from Example 5 in respect that a flexible metallic sleeve 50 of a small wall thickness is used as a conductive member in the place of the fixing roller 5 of Example 5. Their difference also resides in the structure of a holder unit 53.

This induction-heating fixing apparatus, as illustrated in FIG. 34, is provided with a non-rotatable holder unit 53 fixed to a fixing unit frame, a pressing roller 6 disposed so as to be rotated in the direction of an arrow c and pressed against the holder unit 53, and the metallic sleeve 50 nipped between the pressing roller 6 and the holder unit 53 and adapted to follow the rotation of the pressing roller 6.

The metallic sleeve 50 is formed of conductive members such as of nickel and is provided on the outer circumferential surface thereof with a heat-resistant releasable layer formed by coating the surface with a fluorine resin. The metallic sleeve 50 has a wall thickness in the range of 20 μm–60 μm.

Inside the metallic sleeve 50, a coil assembly 52 adapted for causing the metallic sleeve 50 to generate an induced current (eddy current) is disposed. This coil assembly 52 is supported by a holder 54. All these components jointly form a holder unit 53.

The holder unit 53 of Example 6 has a structure in which the coil assembly 52 is wholly encircled with the holder 54. The coil assembly 52 is provided with a core 55 made of a magnetic material, a bobbin 58 containing a through hole 57 for allowing insertion of the core 55, and an induction coil 56 formed by winding a copper wire 21 round the bobbin 58 and adapted for enabling the metallic sleeve 50 to generate an induced current and emit heat. The bobbin 58 functions as an insulating part for insulating the core 55 from the induction coil 56. The coil assembly 52 is stowed as thoroughly concealed inside the holder 54 which is formed as divided in two halves separately from the bobbin 58.

In the fixing apparatus using the metallic sleeve 50, since the holder unit 53 is pressed against the inner circumferential surface of the metallic sleeve 50 and consequently caused to produce friction, the fixing apparatus finds it difficult to use the holder 25 shown by Example 5 and the insulation film or the insulation tube adapted to envelop the holder 25.

In the case of the fixing apparatus which has such a structure as shown above, the holder must be formed with an appreciable thickness (not less than 1 mm where it is made of resin) so as to secure mechanical strength enough to withstand the pressure to be exerted on the pressing roller 6. Meanwhile, the nip part, because of its structure involving relative slide between the metallic sleeve 50 and the holder 54, does not need to keep a gap from the viewpoint of securing smooth rotation as in the case of the fixing roller 5. Thus, the core 55 can be disposed as separated by a gap, d, of not less than 0.5 mm and not more than 4 mm from the inner surface of the metallic sleeve 50 in the same manner as in Example 5 by giving a size, which is the sum of the wall thickness of the holder 54 and a space, α, arising from dispersions of the outside diameters of the metallic sleeve 50 and the holder 54, to the gap between the core 55 and the inner surface of the metallic sleeve 50.

Incidentally, in Example 6, the gap in the area (parts indicated by a slash in FIG. 34) in which the shorter edge of the core 55 (the lateral edge in the bearings of FIG. 34) is opposed to the metallic sleeve 50 always equals the size mentioned above.

Since a size of not more than 4 mm is specified for the gap, the induction-heating fixing apparatus of Example 6 can prevent the cost from rising and contribute to the conservation of energy without incurring the situation in which the temperature of the induction coil 56 itself surpasses 200° C. Since the outer circumferential wall of the holder 54 intervenes between the core 55 and the metallic sleeve 50, the gap infallibly assumes a size of not less than 0.5 mm and ample electric insulation is secured between the core 55 and the metallic sleeve 50. Even when the coating of the induction coil is broken as by excessive temperature elevation, for example, the electric insulation can be secured and the fixing apparatus can be prevented in its entirety from breakage.

EXAMPLE 7

Figure 35:
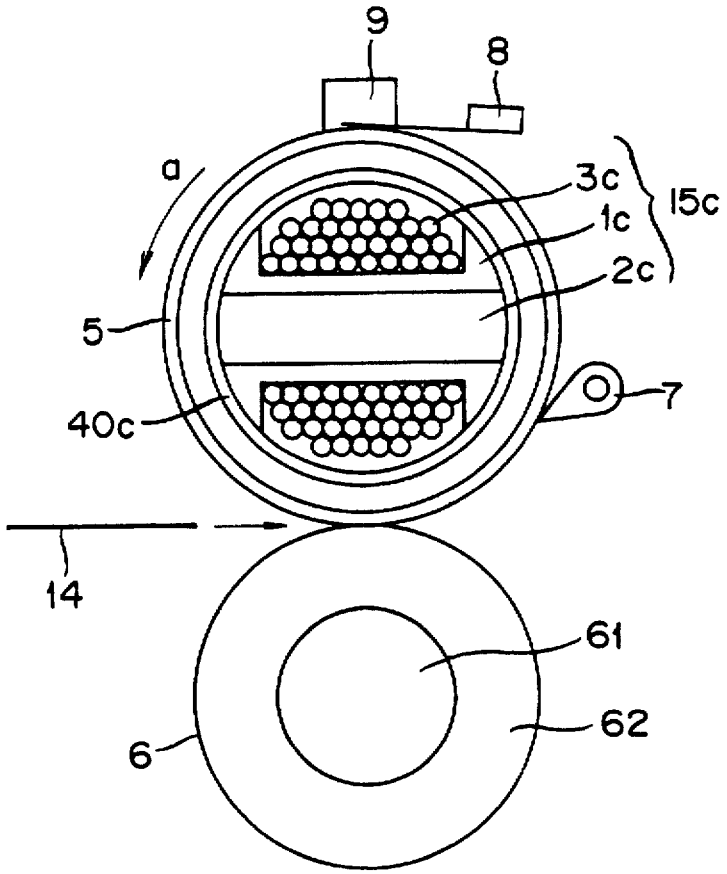
FIG. 35 is a cross section illustrating a fixing apparatus of Example 7 embodying this invention.
Figure 36:
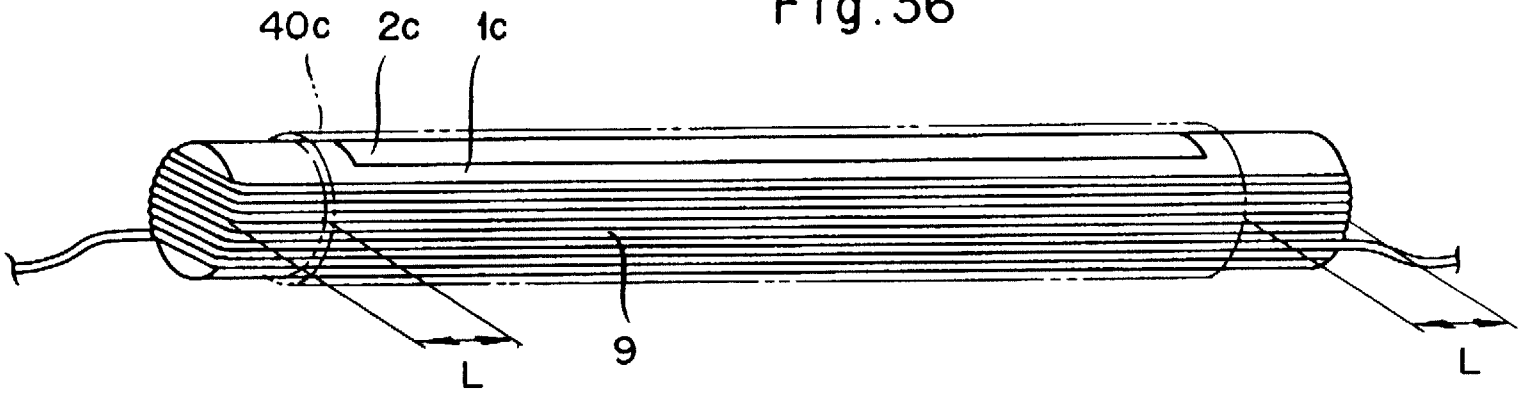
FIG. 36 is a perspective view of the holder unit shown in FIG. 35.

FIG. 35 is a schematic cross section of a fixing apparatus of Example 7 embodying this invention, FIG. 36 a perspective view of a holder unit of the apparatus mentioned above, and FIG. 37 a perspective view illustrating the manner in which the holder unit is stowed inside a fixing roller.

Figure 37:
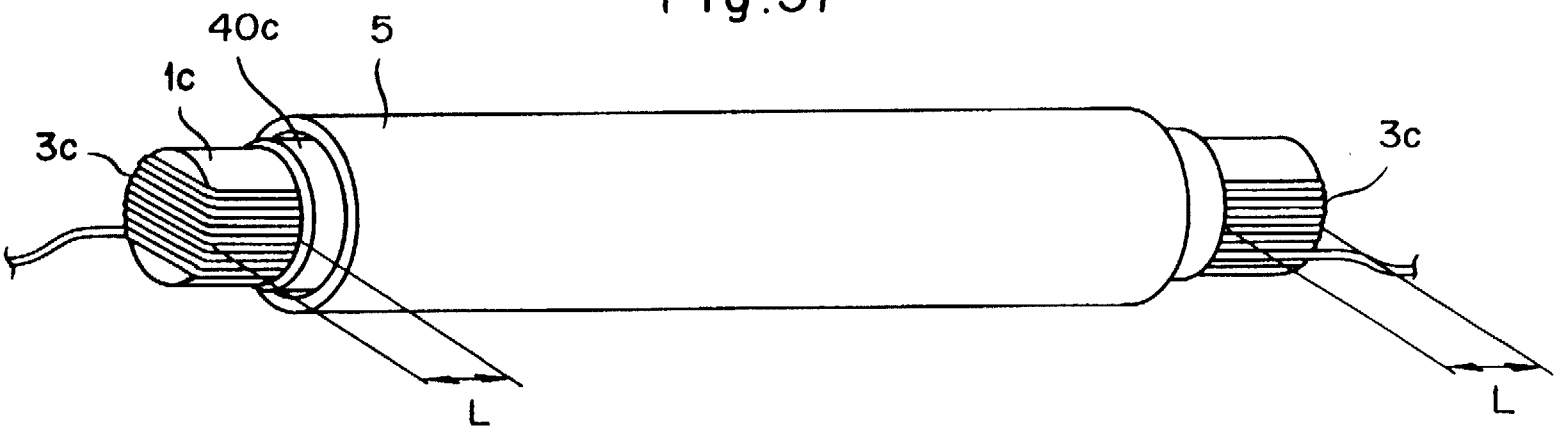
FIG. 37 is a perspective view illustrating the manner of stowing the holder unit inside the fixing roller.

The fixing apparatus of Example 7 is substantially identical in its basic structure shown in FIG. 35 to those of Example 3 through Example 5. The aspect which particularly characterizes Example 7 resides in the fact that an induction coil is thrust out and exposed to view from at least one terminal part in the axial direction of the fixing apparatus as illustrated in FIG. 36 and FIG. 37. The term "axial direction of the fixing apparatus" as used herein refers to the same direction as the axial direction of the fixing roller 5 or the pressing roller 6. The operation of the fixing apparatus is equal to that described in Example 2 above and will be omitted from the following description.

The fixing apparatus of Example 7, as pointed out above, is substantially equal to those of FIG. 3 through FIG. 5. It is provided, as illustrated in FIG. 35, with a fixing roller 5 and a pressing roller 6 pressed against the fixing roller 5 and enabled to follow the rotation of the fixing roller 5.

The fixing roller 5 is a hollow pipe formed of conductive members. Inside the fixing roller 5, a coil assembly **15*c* is set in place. This coil assembly 15*c* is covered with a holder unit 40*c*** which possesses an insulating property.

Figure 38:
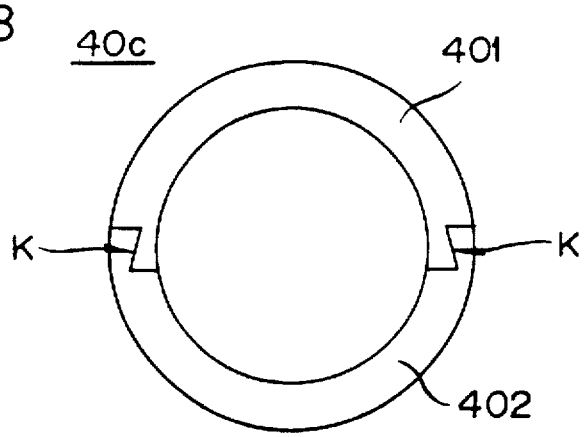
FIG. 38 is a diagram illustrating the holder unit as viewed in the axial direction.

The holder unit **40*c*, as shown in FIG. 38 which depicts the holder unit 40*c* as viewed from the axial direction, is divided into upper and lower halves and is composed of an upper holder 401 and a lower holder 402 which are joined to each other by means of hooked engaging parts K formed in the dividing points. Since it is divided into upper and lower halves, it can be easily formed with resin. The upper holder 401 and the lower holder 402 can be brought into perfect and strong union by being slid against each other in the axial direction through the medium of the hooked engaging parts K. Thus, the holder unit 40*c* is produced easily and inexpensively as endowed with high strength and rigidity. The hooked engaging parts K do not need to be limited to the shape shown in FIG. 38** but may be formed in any other shape so long as the divided halves will be slid into engagement. They may be formed in matching concave and convex shapes, for example.

The fixing roller 5 is provided at the opposite terminals thereof each with a slider bearing part and is rotatably attached to a fixing unit frame (not shown). Further, the fixing roller 5 is provided at one terminal thereof with a drive gear (not shown) and is driven by a drive source (not shown) such as a motor connected to the drive gear. The holder unit **40*c* is fixed to the fixing unit frame and hence rendered non-rotatable and is stowed inside the fixing roller 5 as separated by a gap of a stated size from the inner wall surface of the fixing roller 5**.

The fixing roller 5 is provided with a separation claw 7 adapted to make a sliding contact with the surface thereof. Above the fixing roller 5, a thermistor 8 for detecting the temperature of the fixing roller 5 and a thermostat 9 as a safeguard against abnormal temperature elevation are disposed. The thermistor 8 and the thermostat 9 are pressed against the surface of the fixing roller 5 so as to be opposed to the induction coil 22 across the fixing roller 5.

The fixing roller 5 is formed of such a conductive member as, for example, a steel tube, stainless alloy tube, nickel tube, carbon steel tube, or aluminum alloy tube and has formed on the outer circumferential surface thereof a heat-resistant releasable layer obtained by coating the surface with a fluorine resin. The fixing roller 5 preferably is formed of conductive magnetic members. The pressing roller 6 has a silicone rubber layer 62, a surface-release type heat-resistant rubber layer, formed on the periphery of an axial core 61. Then, the slider bearing and the separation claw 7 are formed of a heat-resistant sliding engineering plastic substance.

Then, in Example 7, the induction coil 3*c* is thrust out and exposed to view from at least one terminal part in the axial direction of the fixing apparatus as illustrated in FIG. 36 and FIG. 37.

Figure 39:
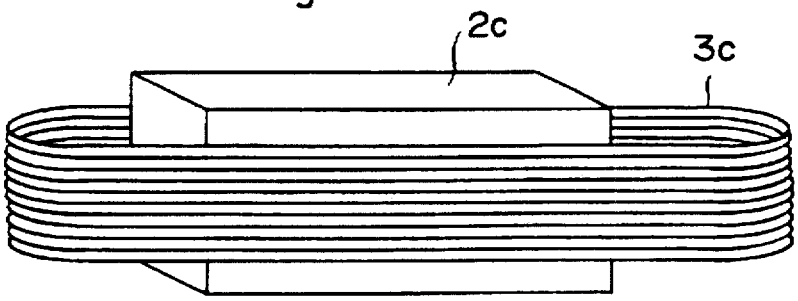
FIG. 39 is a perspective view illustrating the layout of an induction coil relative to a core in a fixing apparatus of Example 7.
Figure 40:
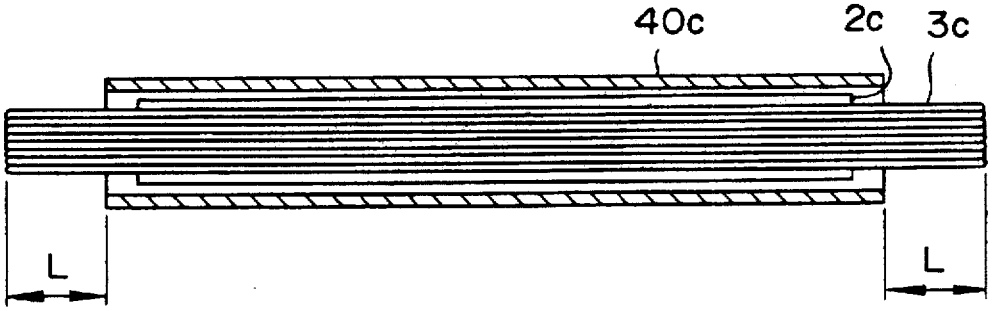
FIG. 40 is a longitudinal section of a holder unit of the fixing apparatus mentioned above.
Figure 41:
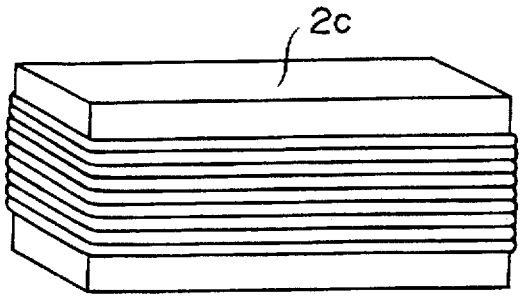
FIG. 41 is a perspective view illustrating the layout of an induction coil relative to a core in a comparative fixing apparatus.
Figure 42:
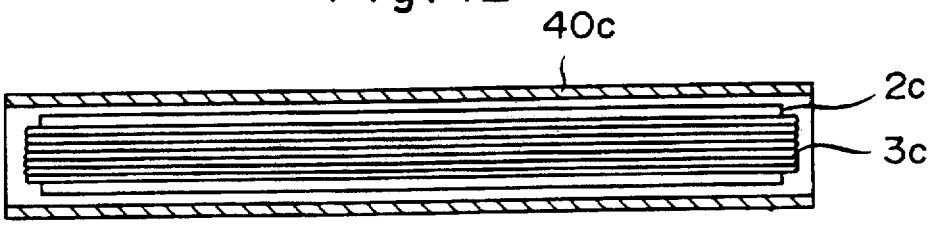
FIG. 42 is a longitudinal section of a holder unit of the fixing apparatus mentioned above.

FIG. 39 is a perspective view illustrating the layout of the induction coil relative to the core in the fixing apparatus of Example 7 embodying this invention, FIG. 40 is a longitudinal section of the holder unit of the apparatus mentioned above, FIG. 41 is a perspective view illustrating the layout of the induction coil relative to the core in the fixing apparatus as posed in a state not exposing the induction coil to view, and FIG. 42 is a longitudinal section of the holder unit of the apparatus mentioned above. The insulation such as a bobbin which is interposed between the core and the induction coil is omitted from the diagrams. In the longitudinal section of the holder unit, the holder alone has its section shown so as to permit clear comprehension of the layout of the holder relative to the induction coil stowed within (similarly applicable to FIGS. 44–49).

Specifically, the induction coil 3*c*, as illustrated in FIG. 40, is disposed as extended so as to protrude in a length, L (mm), each from the opposite terminal parts in the axial direction of the holder unit 40*c*. The reason for projecting the induction coil 3*c* from the holder unit 40*c* in the manner mentioned above is that the coil assembly 15*c* including the induction coil 3*c* is retained inside the cylindrical holder unit 40*c* and the length of the holder unit 40*c* is generally so set as to equal or slightly exceed the length of the fixing roller 5 for the purpose of securing necessary electric insulation between the fixing roller 5 and the induction coil 3*c*. Optionally, the induction coil 3*c* may be so formed as to protrude from one terminal part in the axial direction of the holder unit 40*c*.

In the fixing apparatus of Example 7, the induction coil 3*c* is spontaneously cooled owing to the exposure of the projected parts thereof to the ambient air. More often than not, the induction coil 3*c* is so formed as to be enveloped with the cylindrical holder unit 40*c* of an electrically insulating material from the viewpoint of safety as in the case of Example 7. In this structure, the effect of spontaneous cooling through the exposed parts is manifested particularly conspicuously because the radiation of heat is obstructed and the heat tends to build up within. Besides, the cooling effect is very large because the induction coil 3*c* itself is made of copper, a substance with an outstanding heat-radiating property.

Figure 43:
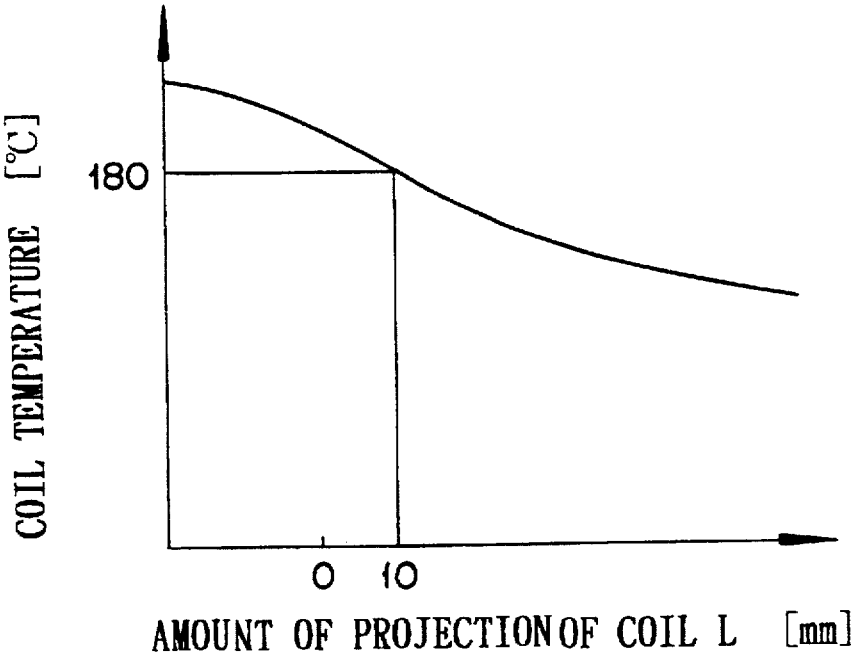
FIG. 43 is a graph showing the relation between the amount of projection of the induction coil and the temperature of the induction coil.

FIG. 43 is a graph showing the relation between the amount of projection of the induction coil and the temperature of the induction coil.

It is clearly noted from this graph that the cooling effect of the induction coil is enhanced in proportion as the amount of projection of the induction coil is increased as evinced by the fact that the fixing apparatus of Example 7 illustrated in FIG. 39 and FIG. 40 enjoys a better cooling effect than the fixing apparatus of the type having the induction coil 3*c* not exposed to view as illustrated in FIG. 41 and FIG. 42.

It is further appropriate practically from the viewpoint of reconciling quality and cost to keep the temperature of the induction coil below 180° C. in consideration of the heat resistance of such parts as the cover and the holder of the induction coil. Generally, therefore, it may be safely concluded that more appropriately the amount of projection, L, of the induction coil is not less than 10 mm.

Thus, the fixing apparatus can promote the radiation of heat from the whole of the induction coil and prevent the induction coil from elevating the temperature of its own. Further, since the induction coil is prevented from excessive heating, the peripheral parts of the induction coil do not need to possess unduly high heat resistance. This fact contributes to further saving of the cost.

Further, the fixing apparatus can be formed only by adding such a simple and inexpensive mechanism that the induction coil 3*c* merely protrudes slightly from the holder unit 40*c* with the same fixing roller 5 and is adaptable even to a fixing roller of a small diameter.

EXAMPLE 8

Figure 44:
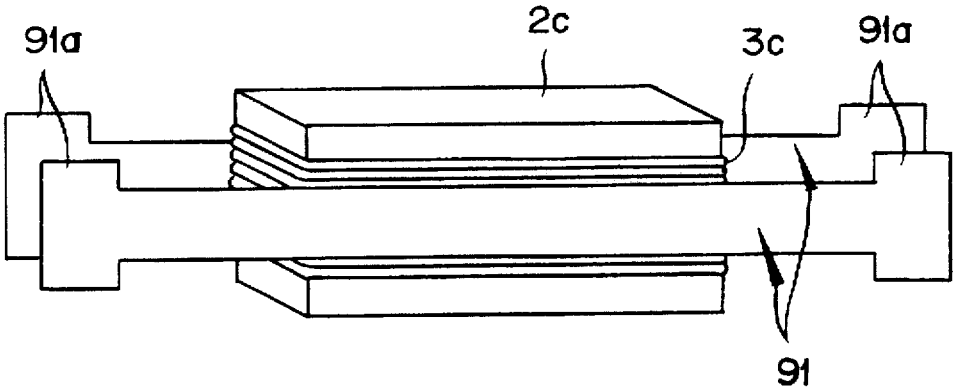
FIG. 44 is a perspective view illustrating the essential part of a fixing apparatus of Example 8 embodying this invention.
Figure 45:
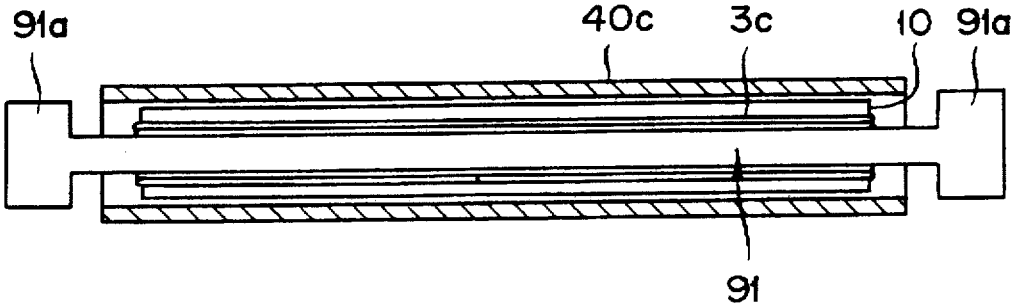
FIG. 45 is a longitudinal section of a holder unit of the fixing apparatus mentioned above.

FIG. 44 is a perspective view illustrating the essential part of a fixing apparatus of Example 8 embodying the present invention and FIG. 45 is a longitudinal section of a holder unit of the apparatus mentioned above. In these diagrams, like parts found in FIG. 35–FIG. 40 used above to aid in the description of Example 7 will be denoted by like reference numerals. These parts will be omitted from the following description.

The fixing apparatus of Example 8, as illustrated in FIG. 44, is provided with a pair of metallic plates 91 as metallic members adapted to contact an induction coil 3*c* and stowed in the fixing roller in conjunction with the induction coil 3*c*. The metallic plates 91, as illustrated in FIG. 45, are disposed as extended so as to protrude from the opposite terminal parts in the axial direction of the holder unit 40*c*. The metallic plates 91 are formed of copper or a copper alloy and, therefore, exhibit an excellent heat-radiating property. They are provided in the terminal parts thereof each with a part 91*a* having the surface of contact with the ambient air enlarged to exalt the heat-radiating property. Example 8 is at an advantage not only in obtaining the same effect as the aforementioned embodiments of the invention by simply disposing the metallic plates without altering the shape of the induction coil but also in facilitating the adjustment of the degree of cooling.

Incidentally, the metallic plates 91 may be formed of some other metallic material of good thermal conductivity such as, for example, aluminum or an alloy thereof. And the number of such metallic plates 91 to be installed is a matter of free choice. Instead of using these metallic plates, a cylindrical copper tube may be slipped over the induction coil 3*c* as held in contact therewith and the copper tube may be extended so as to have the terminal parts thereof thrust out of the opposed terminal parts in the axial direction of the holder unit 40*c*. It is also allowable to have the metallic plates 91 so disposed as to contact not only the induction coil 3*c* but also the core 10.

EXAMPLE 9

Figure 46:
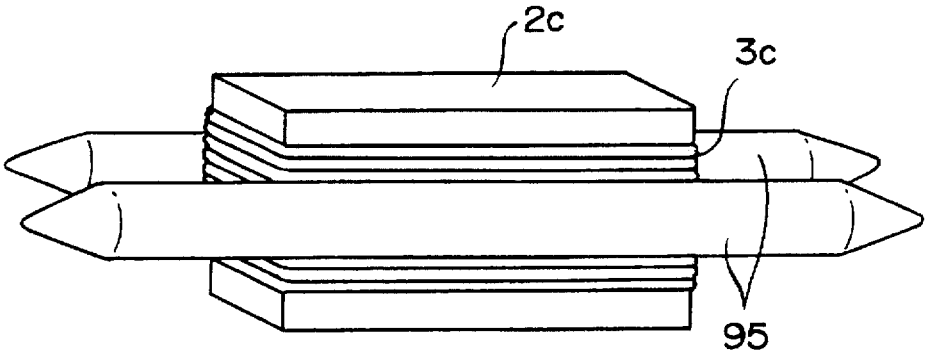
FIG. 46 is a perspective view illustrating the essential part of a fixing apparatus of Example 9 embodying this invention.
Figure 47:
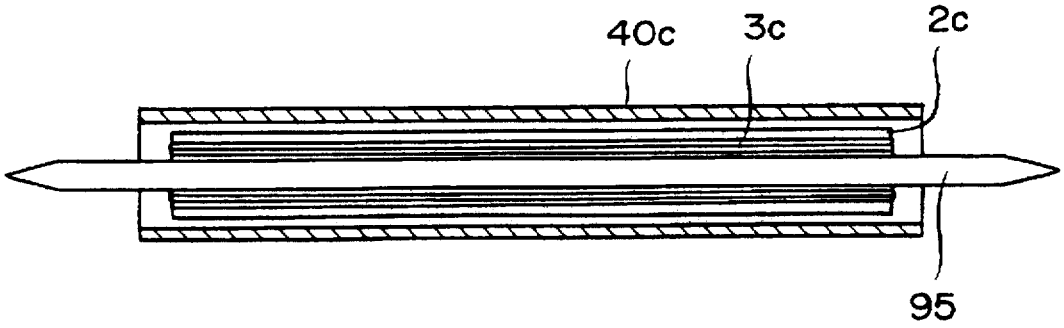
FIG. 47 is a longitudinal section of a holder unit of the fixing apparatus mentioned above.

FIG. 46 is a perspective view illustrating the essential part of a fixing apparatus of Example 9 embodying this invention and FIG. 47 is a longitudinal section of a holder unit of the apparatus mentioned above. In these diagrams, like parts found in FIG. 35–FIG. 40, FIG. 44, and FIG. 45 will be denoted by like reference numerals. These parts will be omitted from the following description.

Example 9 differs from Example 8 in respect that it uses a heat pipe 95 as a metallic member in the place of the metallic plates 91 of Example 8. The heat pipe 95, as is universally known, consists of a sealed metal tube with a lining of capillary material and a working fluid held in the tube in a decompressed state and operates on the principle that the working fluid vaporizes on exposure to heat at one end of the tube, the formed vapor flows to the other end and condenses with release of heat there, and the working liquid consequently restored returns to the heating part by virtue of capillarity. According to Example 9, therefore, the heat pipe 95 laid out in a scanty empty space promotes quick transfer of the heat of the induction coil and further exalts the effect of spontaneous cooling of the induction coil by means of the ambient air.

EXAMPLE 10

Figure 48:
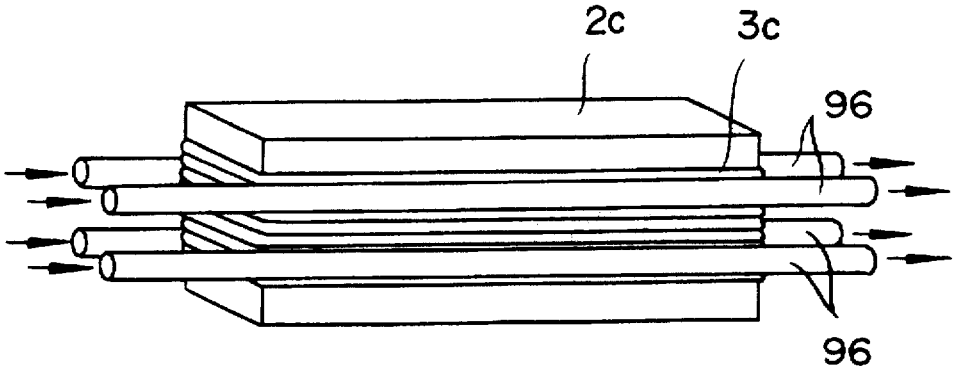
FIG. 48 is a perspective view illustrating the essential part of a fixing apparatus of Example 10 embodying this invention.
Figure 49:
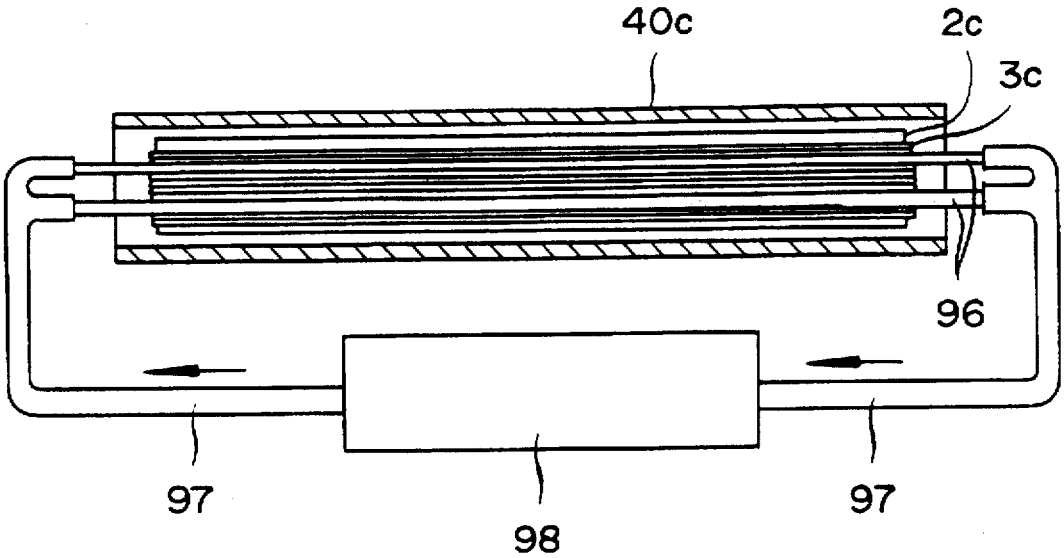
FIG. 49 is a longitudinal section of a holder unit of the fixing apparatus mentioned above.

FIG. 48 is a perspective view illustrating the essential part of a fixing apparatus of Example 10 embodying this invention and FIG. 49 is a diagram illustrating a longitudinal section of a holder unit of the apparatus mentioned above together with cooling means thereof. In these diagrams, like parts found in FIG. 35–FIG. 40, FIG. 44–FIG. 47 will be denoted by like reference numerals. These parts will be omitted from the following description.

Example 10 differs from Example 8 in respect that it uses metallic pipes 96 as metallic members in the place of the metallic plates 91 of Example 8 and circulates a liquid of a large heat capacity inside the metallic pipes 96 in the direction indicated by an arrow mark in the diagram. Example 10, as illustrated in FIG. 49, contemplates positively cooling the induction coil by the use of a cooling means which is formed by transfixing the interior of a holder unit 40*c* with the metallic pipes 96 and connecting a pumping mechanism 98 as a means for circulating the liquid through the medium of a communicating hose 97 to the metallic pipes 96. According to Example 10, therefore, by circulating the cooling liquid through the metallic pipes 96 laid out in a scanty empty space, the heat accumulated in the induction coil 3*c* can be positively and quickly absorbed by the cooling liquid and transferred and the cooling effect of the induction coil can be markedly exalted.

EXAMPLE 11

Figure 50:
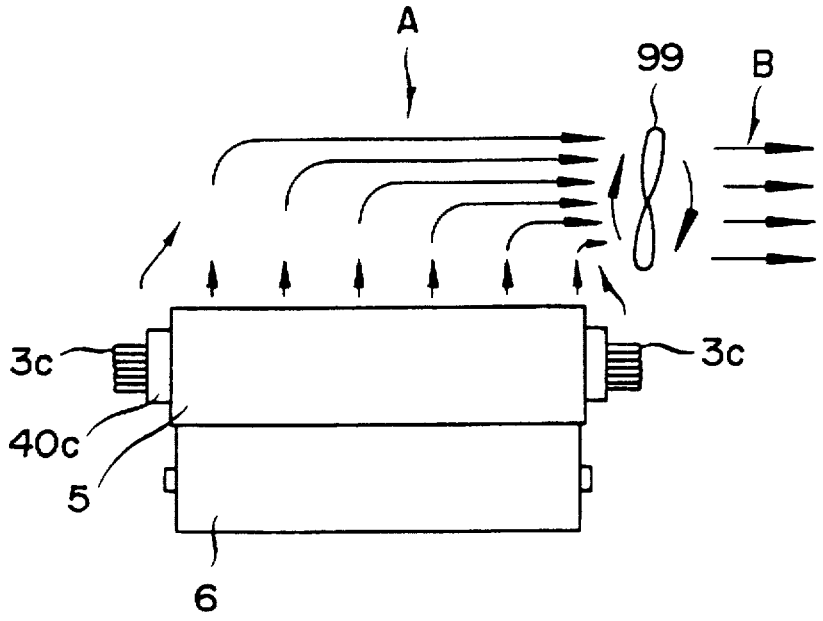
FIG. 50 is a diagram schematically illustrating the structure of a fixing apparatus of Example 11 embodying this invention.

FIG. 50 is a diagram schematically illustrating the structure of a fixing apparatus of Example 11 embodying this invention. In this diagram, like parts found in FIG. 35–FIG. 40, FIG. 44–FIG. 49 will be denoted by like reference numerals. These parts will be omitted from the following description.

In Example 11, an air blower 99 which is generally used in the main body of such an image forming apparatus as a copying machine for the purpose of cooling the interior of the main body is disposed in the proximity of one terminal part in the axial direction of the fixing apparatus, namely in the proximity of the part of the induction coil 3*c* thrust out and exposed to view. The air blower 99 is intended to cool mainly a conventionally installed power source (not shown) and the fixing apparatus. When this air blower 99 is laid out as described above, the fixing apparatus no longer requires any extra fan for the purpose of cooling and further exalts the cooling effect of the induction coil. In the diagram, the symbol "A" indicates the flow of air inside the main body of the image-forming apparatus and the symbol "B" the flow of air discharged out of the main body. Of course, it is permissible to install additionally an induction coil-cooling fan which is adapted to force a flow of air in the axial direction through the interior of the fixing roller for the purpose of further exalting the cooling effect.

It should be understood that the invention is not limited to the particular embodiments shown and described hereinabove but that it may be implemented by suitably combining the embodiments, with various changes and modifications made therein without departing from the spirit and scope of this novel concept as defined by the following claims. For example, structures which combine the characteristic features of the embodiments mentioned above and, at the same time, use a multiplicity of induction coils arranged in a plurality of parallelly connected rows, structures which use induction coils, 0.2–0.8 mm in outside diameter, in the embodiments mentioned above, and structures which have the numbers of turns of the induction coil gradually decreased from the lowermost layer to the upper layers in the embodiments mentioned above may be cited.

We claim:

1. A heating apparatus comprising:

a power supply;

a first induction coil which is connected to the power supply;

a second induction coil which is connected to the power supply in parallel to the first induction coil, wherein said second induction coil is arranged coaxially to the first induction coil; and a conductive member which is heated by eddy current, said eddy current being brought by current flowing in the first and second induction coils.

2. The heating apparatus as claimed in claim 1, wherein the conductive member has the shape of hollow cylinder and the first and second induction coils are arranged inside the conductive member.

3. The heating apparatus as claimed in claim 2, wherein the heating apparatus is used for a fixing roller of an image forming apparatus.

4. A heating apparatus comprising:

a power supply;

a core;

a wire which is connected to the power supply, said wire being winded around the core at least three layers so as to form an induction coil, wherein a number of turns of winding of the wire of each layer is different from other layers; and a conductive member which is heated by eddy current, said eddy current being brought by current flowing in the wire.

5. The heating apparatus as claimed in claim 4, wherein the winding number of the wire in the lower layer is more than that in the higher layer.

6. The heating apparatus as claimed in claim 4, wherein the number of turns of winding of the wire is gradually decreased from said lower layer to said higher layer.

7. A fixing apparatus which fixes a toner image on a recording medium, comprising:

a power supply;

an induction coil which is connected to the power supply, said induction coil being from 0.2 mm to 0.8 mm in diameter; and a conductive member which is heated by eddy current, said eddy current being brought by current flowing in the induction coil.

8. The fixing apparatus as claimed in claim 7, wherein the conductive member has the shape of hollow cylinder and the induction coil is arranged inside the conductive member.

9. The fixing apparatus as claimed in claim 7, wherein the induction coil is formed by a litz wire.

10. A heating apparatus comprising:

a power supply;

a coil member which includes an induction coil, said coil member being connected to the power supply; and a conductive member which is heated by eddy current, wherein said conductive member is a rotary member in a range of 10 mm to 60 mm as outside diameter, said eddy current being brought by current flowing in the induction coil and said conductive member being away from the coil member at a distance of 0.5 mm to 4 mm.

11. The heating apparatus as claimed in claim 10, wherein the conductive member has the shape of hollow cylinder and the coil member is arranged inside the conductive member.

12. The heating apparatus as claimed in claim 10, wherein the coil member further includes a core which is used for winding the induction coil and the conductive member is away from the core at a distance of 0.5 mm to 4 mm.

13. The heating apparatus as claimed in claim 12, wherein the coil member further includes a support member which supports the induction coil and the core.

14. A heating apparatus comprising:

a power supply;

a coil member which includes an induction coil, said coil member being connected to the power supply;

a conductive member which is heated by eddy current, said eddy current being brought by current flowing in the induction coil; and wherein the coil member is arranged inside of the conductive member and a part of the coil member is projected from the conductive member.

15. The heating apparatus as claimed in claim 14, wherein a length of the exposed part of the coil member is 10 mm or more.

16. The heating apparatus as claimed in claim 14, wherein the induction coil itself is projected from the conductive member.

17. The heating apparatus as claimed in claim 14, wherein only the induction coil is projected from the conductive member.

18. The heating apparatus as claimed in claim 14, wherein the coil member further includes a metallic member and a part of the metallic member is exposed out of the conductive member.

19. The heating apparatus as claimed in claim 18, wherein the metallic member is a metallic plate.

20. The heating apparatus as claimed in claim 18, wherein a tip of the exposed part of the metallic member is sharp-pointed.

21. The heating apparatus as claimed in claim 14, wherein the coil member further includes a mechanism which flows liquid in the coil member.

22. A heating apparatus comprising:

a power supply;

an induction coil which is connected to the power supply, said induction coil being formed by a litz wire, wherein said litz wire has a diameter of 0.2 mm to 0.8 mm; and a conductive member which is heated by eddy current, said eddy current being brought by current flowing in the induction coil.

23. The heating apparatus as claimed in claim 22, wherein a twisting pitch of the induction coil is less than 200 mm.

* * * * *